US007991554B2

(12) United States Patent
Calhoun et al.

(10) Patent No.: US 7,991,554 B2
(45) **Date of Patent: *Aug. 2, 2011**

(54) METHOD FOR PREDICTING RATE OF PENETRATION USING BIT-SPECIFIC COEFFICIENTS OF SLIDING FRICTION AND MECHANICAL EFFICIENCY AS A FUNCTION OF CONFINED COMPRESSIVE STRENGTH

(75) Inventors: William Malcolm Calhoun, The Woodlands, TX (US); Hector Ulpiano Caicedo, Houston, TX (US); Russell Thomas Ewy, San Ramon, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 346 days.

This patent is subject to a terminal disclaimer.

(21) Appl. No.: 12/137,752

(22) Filed: Jun. 12, 2008

(65) Prior Publication Data

US 2008/0249714 A1 Oct. 9, 2008

Related U.S. Application Data

(63) Continuation of application No. 11/015,899, filed on Dec. 16, 2004, now Pat. No. 7,412,331.

(51) Int. Cl.
*G01V 1/40* (2006.01)
*E21B 45/00* (2006.01)

(52) U.S. Cl. ..... 702/9; 73/152.44

(58) Field of Classification Search ..... 702/9, 1–2, 702/10–13; 73/152.01–152.03, 152.43–152.44, 73/152.46, 152.49, 152.51; 175/39–40, 50
See application file for complete search history.

(56) References Cited

U.S. PATENT DOCUMENTS

| | | | |
|---|---|---|---|
| 4,914,591 | A | 4/1990 | Warren et al. |
| 4,981,037 | A | 1/1991 | Holbook et al. |
| 5,205,164 | A | 4/1993 | Steiger et al. |
| 5,216,917 | A | 6/1993 | Detournay |
| 5,305,836 | A | 4/1994 | Holbook et al. |
| 5,318,136 | A | 6/1994 | Rowsell et al. |

(Continued)

FOREIGN PATENT DOCUMENTS

WO WO 01/25597 A1 4/2001

OTHER PUBLICATIONS

Pessier et al., Quantifying Common Drilling Problems With Mechanical Specific Energy and a Bit-Specific Coefficient of Sliding Friction, 1992, SPE 24584, pp. 373-388.*

(Continued)

*Primary Examiner* — Michael P Nghiem
*Assistant Examiner* — Toan M Le
(74) *Attorney, Agent, or Firm* — Merchant & Gould

(57) ABSTRACT

A method for predicting the rate of penetration (ROP) of a drill bit drilling a well bore through intervals of rock of a subterranean formation is provided based on determined relationships between a bit-specific coefficient of sliding friction μ and mechanical efficiency $EFF_M$ and confined compressive strength CCS over a range of confined compressive strengths CCS. Confined compressive strength CCS is estimated for intervals of rock through which the drill bit is to be used to drill a well bore. The rate of penetration ROP is then calculated utilizing the estimates of confined compressive strength CCS and those determined relationships.

17 Claims, 16 Drawing Sheets

U.S. PATENT DOCUMENTS

| | | | | |
|---|---|---|---|---|
| 5,415,030 | A | 5/1995 | Jogi et al. | |
| 5,416,697 | A | 5/1995 | Goodman | |
| 5,704,436 | A | 1/1998 | Smith et al. | |
| 5,767,399 | A | 6/1998 | Smith et al. | |
| 6,095,262 | A | 8/2000 | Chen | |
| 6,109,368 | A | 8/2000 | Goldman et al. | |
| 6,131,673 | A | 10/2000 | Goldman et al. | |
| 6,167,964 | B1 | 1/2001 | Kenter et al. | |
| 6,169,967 | B1 | 1/2001 | Dahlem et al. | |
| 6,353,799 | B1 | 3/2002 | Meany et al. | |
| 6,374,926 | B1 | 4/2002 | Goldman et al. | |
| 6,386,297 | B1 | 5/2002 | Cooley et al. | |
| 6,408,953 | B1 | 6/2002 | Goldman et al. | |
| 6,412,577 | B1 | 7/2002 | Chen | |
| 6,424,919 | B1 | 7/2002 | Moran et al. | |
| 6,612,382 | B2 | 9/2003 | King | |
| 6,631,772 | B2 | 10/2003 | Palaschenko | |
| 6,634,441 | B2 | 10/2003 | Palaschenko | |
| 7,032,689 | B2 | 4/2006 | Goldman et al. | |
| 7,412,331 | B2 * | 8/2008 | Calhoun et al. | 702/9 |
| 7,555,414 | B2 * | 6/2009 | Calhoun et al. | 703/2 |
| 2003/0015351 | A1 | 1/2003 | Goldman et al. | |
| 2003/0051918 | A1 | 3/2003 | Chen | |
| 2004/0000430 | A1 | 1/2004 | King | |

OTHER PUBLICATIONS

T.M. Warren et al., Bottomhole Stress Factors Affecting Drilling Rate at Depth, Journal of Petroleum Technology, Aug. 1985, pp. 1523-1533, SPE 13381.

E.C. Onyla, Relationships Between Formation Strength, Drilling Strength, and Electric Log Properties, Society of Petroleum Engineers, pp. 505-518, SPE 18166 (1988).

J.M. Cook et al, Effects of Strain Rate and Confining Pressure on the Deformation and Failure of Shale, SPE Drilling Engineering, Jun. 1991, pp. 100-103, SPE 19944.

M.R. McLean et al., Wellbore Stability: The Effect of Strength Criteria on Mud Weigh Recommendations, Society of Petroleum Engineers, pp. 9-17, SPE 20405 (1990).

R.C. Pessier et al., Quantifying Common Drilling Problems with Mechanical Specific Energy and a Bit-Specific Coefficient of Sliding Friction, Society of Petroleum Engineers, pp. 373-388, SPE 24584 (1992).

J.R. Spaar et al., Formation Compressive Strength Estimates for Predicting Drillability and PDC Bit Selection, Society of Petroleum Engineers, pp. 569-578, SPE/IADC 29397 (1995).

A.W. Skempton, The Pore-Pressure Coefficients A and B, Geotechnique (1954), vol. 4, pp. 143-147.

Special Section Prestack Depth Migration, The Society of Exploration Geophysicists, ISSN 1070-485X, The Leading Edge, May 2001, vol. 20, No. 5, pp. 492-496.

N. Turk et al., Estimation of Friction Properties of Rocks from Deformation Measurements, Chapter 14, Proceedings of the 27$^{th}$ U.S. Symposium on Rock Mechanics, Tuscaloosa, Alabama, Jun. 23-25, 1986, pp. 93-99.

R. Teale, The Concept of Specific Energy in Rock Drilling, International Journal of Rock Mechanics and Mining Sciences, 1965, vol. 2, pp. 57-73.

Thiercelin, "The Mechanics of Shales", Schlumberger Cambridge Research, estimated publication date of approx. 1988, pp. 45-56.

* cited by examiner

METHOD FOR PREDICTING RATE OF PENETRATION USING BIT-SPECIFIC COEFFICIENTS OF SLIDING FRICTION AND MECHANICAL EFFICIENCY AS A FUNCTION OF CONFINED COMPRESSIVE STRENGTH

CROSS-REFERENCE TO RELATED APPLICATIONS

This application is a continuation of U.S. application Ser. No. 11/015,899, filed Dec. 16, 2004, now U.S. Pat. No. 7,412,331, and incorporates by reference U.S. patent application entitled "Method for Estimating Confined Compressive Strength for Rock Formations Utilizing Skempton Theory" by William Malcolm Calhoun and Russell Thomas Ewy, Ser. No. 11/015,911, filed Dec. 16, 2004, now U.S. Pat. No. 7,555,414.

FIELD OF THE INVENTION

The present invention relates generally to the drilling of well bores in subterranean formations, and more particularly, to methods for predicting and optimizing the rate at which the well bores are drilled including the proper selection of drill bits and bit performance assessment.

BACKGROUND OF THE INVENTION

It has become standard practice to plan wells and analyze bit performance by using log-based rock strength analysis and/or specific energy theory. The most widely used characterization of rock strength is unconfined compressive strength (UCS), but this is somewhat problematic because the apparent strength of the rock to the bit is typically different than UCS. Specific energy theory has been used for bit performance assessment for years. One of the challenges of application of the specific energy theory, however, is uncertainty or lack of consistency in reasonable values for input variables to be used in specific energy based equations.

The present invention addresses the need to provide reasonable values for the input variables used to predict rate of penetration and reactive torque of a drill bit using specific energy theory

SUMMARY OF THE INVENTION

A method for predicting the rate of penetration (ROP) of a drill bit drilling a well bore through intervals of rock of a subterranean formation is provided. The method uses an equation based upon specific energy principles. For a drill bit, relationships are determined between confined compressive strength CCS and (1) a bit-specific coefficient of sliding friction, (2) mechanical efficiency $EFF_M$, (3) weight on bit WOB, and (4) bit rpm N. These relationships are determined over a range of confined compressive strengths CCS and for a number of predominant bit types. The confined compressive strength CCS is estimated for intervals of rock through which the drill bit is to be used to drill a well bore. The rate of penetration ROP and bit torque is then preferably calculated utilizing the estimates of confined compressive strength CCS of the intervals of rock to be drilled and bit type as the only inputs. Alternatively, ROP and bit torque can be calculated utilizing one or more of the input coefficients/parameters appropriately determined by another equally suitable method or specified as a constant, and the estimates of confined compressive strength and bit type as the only inputs for coefficients/parameters not determined by another method or specified as constant.

Correction factors may also be determined for the effect that mud weight and bit configuration have on those relationships between the coefficient of sliding friction μ and mechanical efficiency $EFF_M$ and the estimated CCS values.

The present invention establishes relationships for specific types of drill bits for bit-specific coefficients of sliding friction μ and mechanical efficiency $EFF_M$, and preferably weight on bit WOB and rpm N all as a function of apparent rock strength and drilling environment (mud weight, equivalent circulating density (ECD) etc.), and then uses these relationships to predict reasonable and achievable ROP and associated bit torque based upon the apparent strength of the rock which is to be drilled.

BRIEF DESCRIPTION OF THE DRAWINGS

These and other objects, features and advantages of the present invention will become better understood with regard to the following description, pending claims and accompanying drawings where:

DETAILED DESCRIPTION OF THE INVENTION

I. Overview

Figure 1:
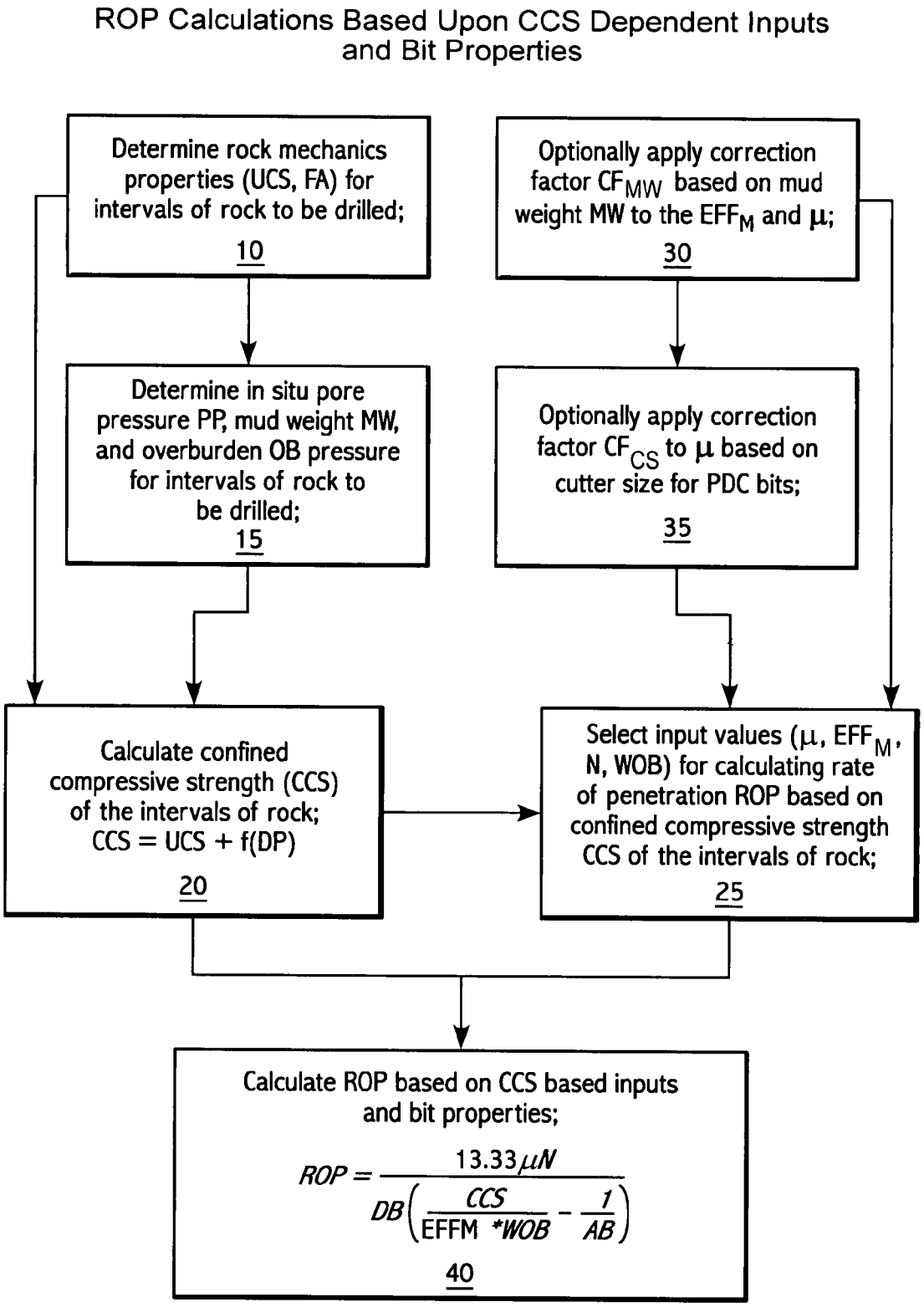
FIG. 1 is a flowchart of steps used in a preferred embodiment of the present invention to predict rate of penetration ROP for a drill bit drilling through intervals of rock of a subterranean formation.

FIG. 1 illustrates a flowchart of steps taken in a preferred embodiment of the present invention for calculating the rate of penetration (ROP) by a particular type of drill bit into a subterranean formation under specified drilling conditions. Details of these steps will be described in greater detail below. The rate of penetration ROP for the well bore is preferably estimated using specific energy theory. More particularly, equation (1) ideally is used to calculate the ROP as follows:

$$ROP = \frac{13.33\ \mu N}{DB\left(\frac{CCS}{EFF_M * WOB} - \frac{1}{A_B}\right)} \quad (1)$$

where:

ROP=Rate of penetration by a bit (ft/hr);

μ=bit-specific coefficient of sliding friction;

N=rotational speed of drill bit (revolutions per minute (RPM));

$D_B$=diameter of bit (inches);

CCS=confined compressive strength (apparent strength of the rock to the bit (psi));

$EFF_M$=mechanical efficiency of the bit (percent);

WOB=weight on bit (pounds); and $A_B$=area of bit (square inches).

Referring now to the flowchart of FIG. 1, rock properties of the subterranean region to be drilled is determined in step 10. In particular, properties are determined such as unconfined compressive rock strength (UCS) and friction angle (FA) for intervals of rock to be drilled. Core samples from nearby well bores may be obtained and analyzed to determine properties of the rock which are likely to be encountered during the drilling of a well bore. Alternatively, by way of example and not limitation, such properties could be estimated from open hole logs or from seismic surveys. Next in step 15, properties such as in situ pore pressure PP of the rock, mud weights MW likely to be used during the drilling operation and overburden (OB) pressure for a given depth of formation are calculated. From these properties, the apparent rock strength (confined compressive strength CCS) for intervals of rock along the well bore path is determined in step 20.

Figure 2A:
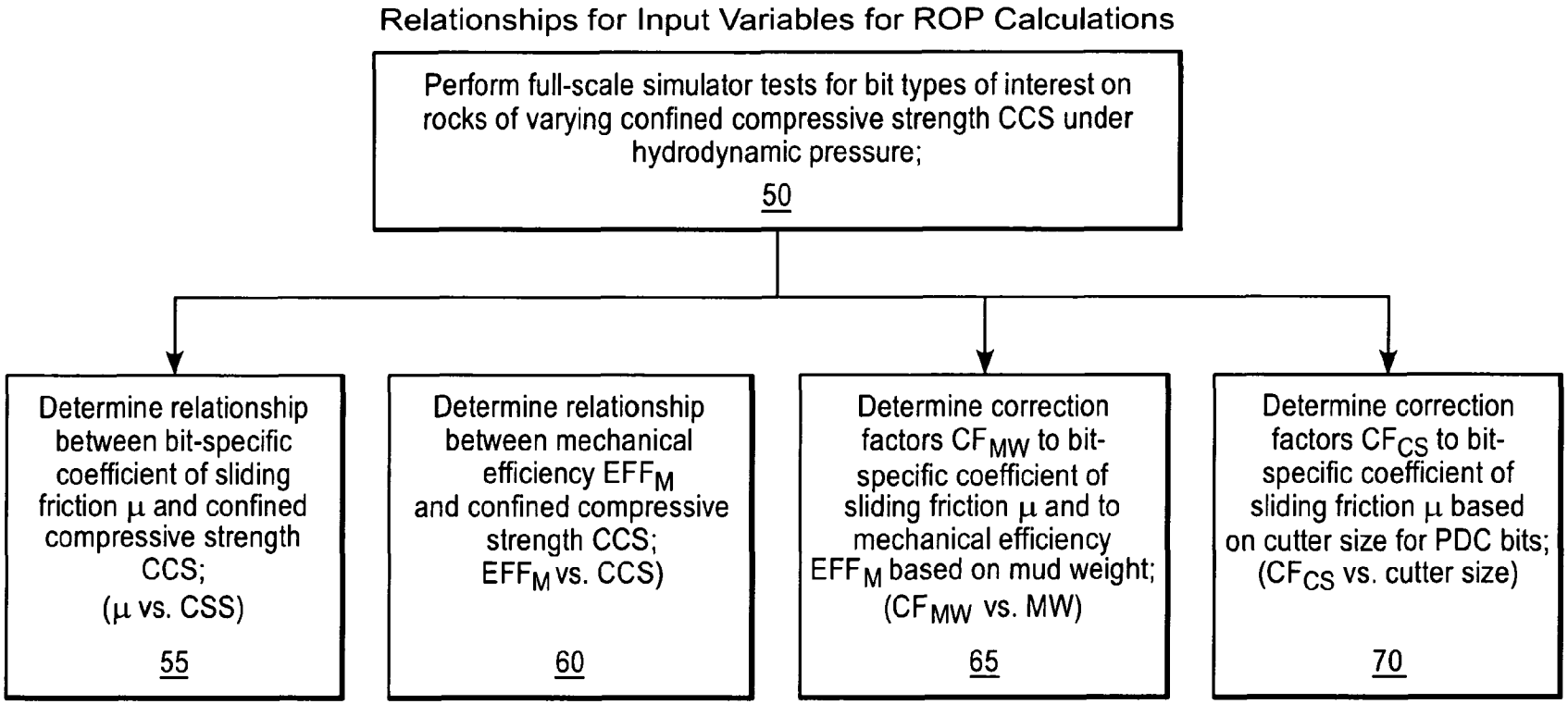
FIGS. 2A and 2B are flowcharts for determining bit-specific relationships for input variables used in calculating ROP in FIG. 1, the relationships being determined based upon simulator testing or expert based knowledge.
Figure 2B:
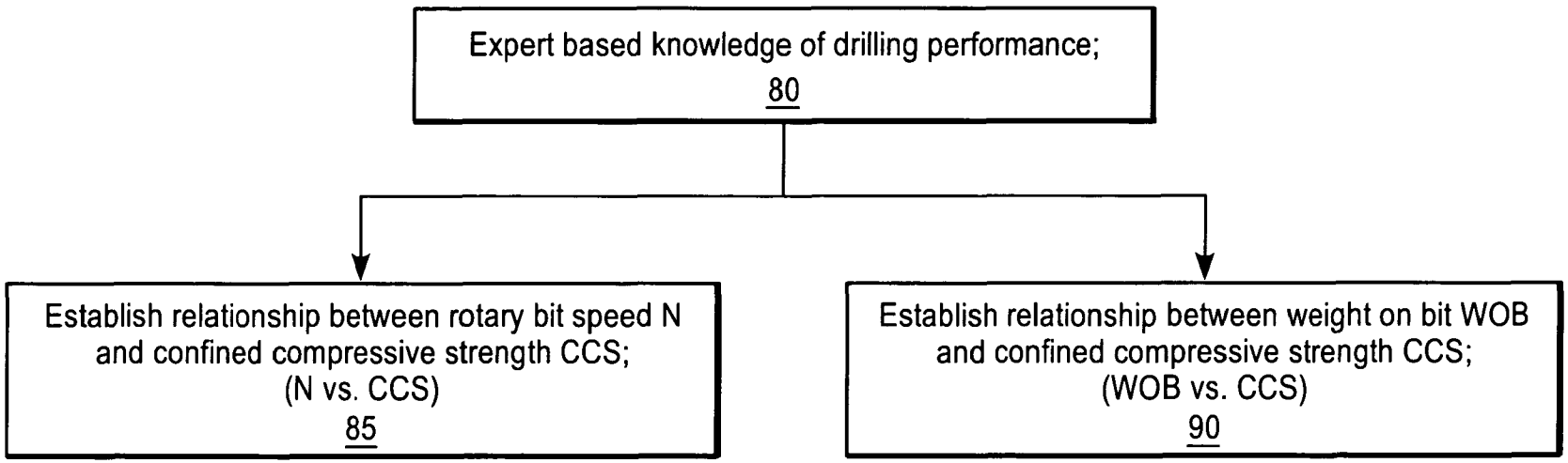

Knowing the calculated CCS for an interval of rock, input values for μ, $EFF_M$, N, and WOB can be rapidly obtained from relationships which have previously been determined such as by simulator testing or using expert based knowledge. FIGS. 2A and B illustrate the source of how these relationships are established. Bit characteristics such area of bit $A_B$ and diameter of bit $D_B$ are known based upon the particular bit size for which the ROP calculation is to be performed.

Values for these input variables may be modified in appropriate cases. For example, correction factors for $CF_{MW}$ may be applied in step 30 to $EFF_M$ and p if the mud weight to be used for drilling is different from that mud weight under which the relationship between $EFF_M$ and p and CCS were determined. Likewise, a correction factor $CF_{CS}$ may be applied in step 35 to μ if the cutter size of a PCD bit is different from a PCD bit which was used to develop the μ vs. CCS relationship.

In step, 40 the aforementioned inputs can be used to calculate the ROP of the drill bit utilizing equation (1). Preferably, these inputs are known based upon the CSS of the particular interval of rock being drilled and the drill bit configuration.

Referring now to FIG. 2A, in order to determine the coefficients of sliding friction u and the mechanical efficiencies $EFF_M$ for each particular type of drill bit, full scale simulators tests using hydrodynamic pressures that are typically encountered under normal drilling conditions are performed in step 50. Test results from these full scale simulator tests are used in steps 55 and 60 to establish relationships of bit-specific coefficients of sliding friction μ and mechanical efficiency $EFF_M$ as a function of confined compressive strength CCS of the rock. Correction factors $CF_{MW}$ and $CF_{CS}$ due to mud weight and cutter size of bit used may also be derived from simulator tests using different mud weights and bits with differing cutter sizes.

Optionally, relationships N versus CCS and WOB versus CCS may also be established in steps 85 and 90. These relationships are generally based upon the expert knowledge 80 of an experienced drilling engineer, bit type, and rock strength.

Using the above methodology and globally applicable rock property determination techniques, ROP can be determined very rapidly for numerous bit types with reasonable accuracy and without any calibration.

II. Determination of Confined Compressive Strength Based Upon Rock Mechanics Principles The method of the present invention relies upon using an estimated apparent strength of rock to the bit or confined compressive strength (CCS). The preferred method of estimating CCS utilizes a well known rock mechanics formula which has been adapted to more accurately estimate CCS for rocks of low and limited permeability. This preferred method of calculating CCS is described in co-pending application entitled "Method for Estimating Confined Compressive Strength for Rock Formations Utilizing Skempton Theory" which was concurrently filed with this application. A condensed description of this preferred method will be described below.

An important part of the strength of a rock to resist drilling depends upon the compressive state under which the rock is subjected. This apparent rock strength of rock to resist drilling by a drill bit under the confining conditions of drilling shall be referred to as a rock's confined compressive strength CCS. Prior to drilling, the compressive state of a rock at a particular depth is largely dependent on the weight of the overburden being supported by the rock. During a drilling operation the bottom portion of a vertical well bore, i.e., rock in the depth of cut zone, is exposed to drilling fluids rather than to the overburden which has been removed.

Ideally, a realistic estimate of in situ pore pressure PP in a bit's depth of cut zone is determined when calculating confined compressive strength CCS for the rock to be drilled. This depth of cut zone is typically on the order of zero to 15 mm, depending on the penetration rate, bit characteristics, and bit operating parameters. The preferred method of calculating CCS includes a novel way to calculate the altered pore pressure PP at the bottom of the well bore (immediately below the bit in the depth of cut zone), for rocks of limited permeability.

Figure 3:
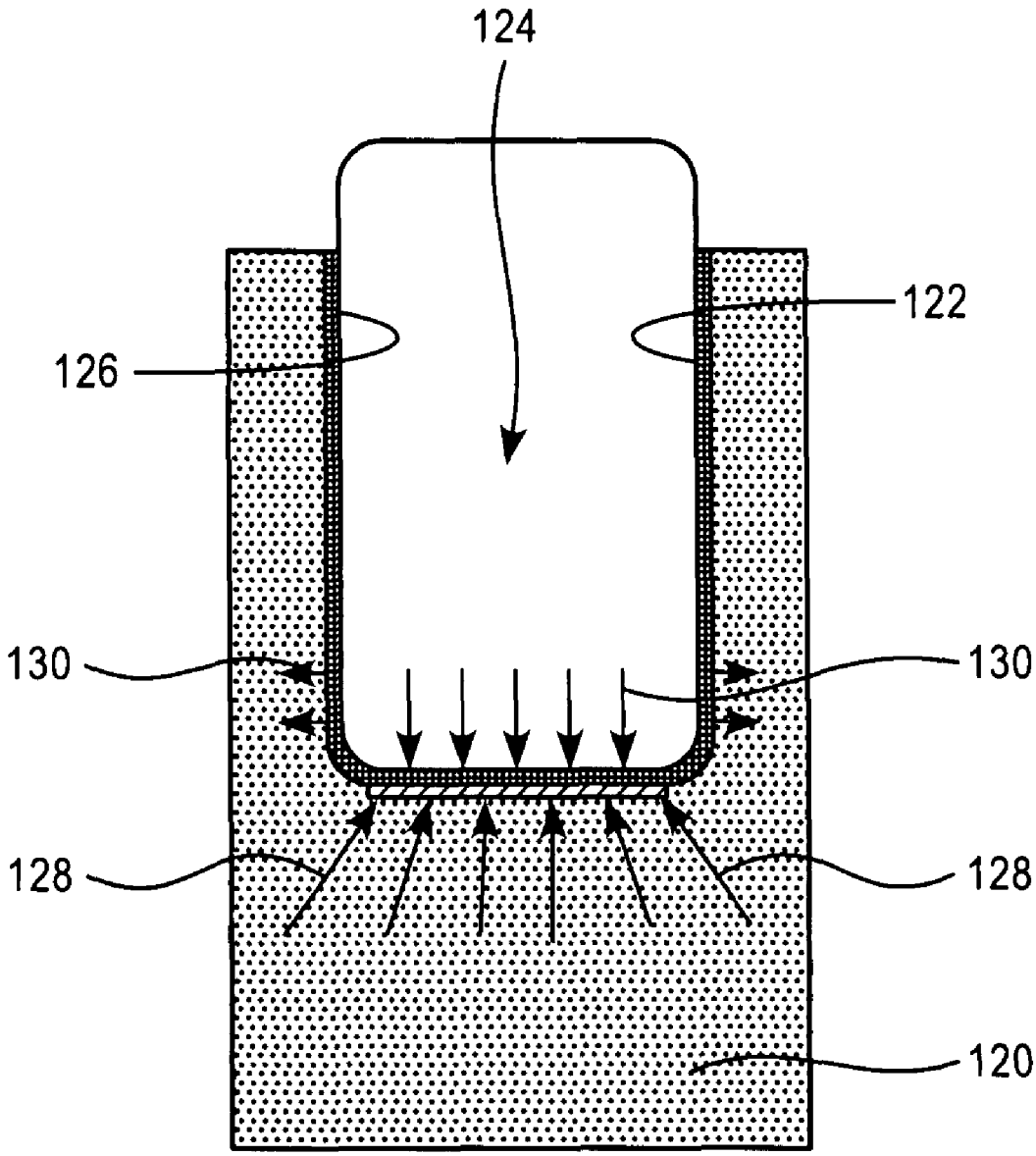
FIG. 3 is a schematic drawing of a well bore and confining fluid pressures applied to rock in a depth of cut zone during drilling of rock by a drill bit.

While not wishing to be held to a particular theory, the following describes the general assumptions made in arriving at a method for calculating confined compressive strength (CCS) for rock being drilled using a drill bit and drilling fluid to create a generally vertical well bore with a flat profile. Referring now to FIG. 3, a bottom hole environment for a vertical well in a porous/permeable rock formation is shown.

A rock formation 120 is depicted with a vertical well bore 122 being drilled therein. The inner periphery of the well bore 122 is filled with a drilling fluid 124 which creates a filter cake 126 lining well bore 122. Arrows 128 indicate that pore fluid in rock formation 120, i.e., the surrounding reservoir, can freely flow into the pore space in the rock in the depth of cut zone. This is generally the case when the rock is highly permeable. Also, the drilling fluid 124 applies pressure to the well bore as suggested by arrows 130.

The rock previously overlying the depth of cut zone, which exerted an "overburden stress or OB pressure" prior to the drilling of the well bore, has been replaced by the drilling fluid 124. Although there can be exceptions, the fluid pressure exerted by the drilling fluid 124 is typically greater than the in situ pore pressure PP in the depth of cut zone and less than the overburden OB pressure previously exerted by the overburden. Under this common drilling condition, the rock in the depth of cut zone expands slightly at the bottom of the hole or well bore due to the reduction of stress (pressure from drilling fluid is less than overburden pressure OB exerted by overburden). Similarly, it is assumed that the pore volume in the rock also expands. Contrarily, it is assumed that the rock and its pores will contract in the case where drilling fluid ECD pressure is greater than the removed overburden OB pressure. The expansion of the rock and its pores will result in an instantaneous pore pressure PP decrease in the affected region if no fluid flows into the pores of the expanded rock in the depth of cut zone.

If the rock is highly permeable, the pore pressure reduction results in fluid movement from the far field (reservoir) into the expanded region, as indicated by arrows 128. The rate and degree to which pore fluid flows into the expanded region, thus equalizing the pore pressure of the expanded rock to that of the far field (reservoir pressure), is dependent on a number of factors. Primary among these factors is the rate of rock alteration which is correlative to rate of penetration and the relative permeability of the rock to the pore fluid. This assumes that the reservoir volume is relatively large compared to the depth of cut zone, which is generally a reasonable assumption. At the same time, if drilling fluid or ECD pressure is greater than in situ pore pressure PP, filtrate from the drilling fluid will attempt to enter the permeable pore space in the depth of cut zone. The filter cake 126 built during the initial mud invasion (sometimes referred to as spurt loss) acts as a barrier to further filtrate invasion. If the filter cake 126 build up is efficient, (very thin and quick, which is desirable and often achieved) it is reasonable to assume that the impact of filtrate invasion on altering the pore pressure PP in the depth of cut region is negligible. It is also assumed that the mud filter cake 126 acts as an impermeable membrane for the typical case of drilling fluid pressure being greater than pore pressure PP. Therefore, for highly permeable rock drilled with drilling fluid, the pore pressure in the depth of cut zone can reasonably be assumed to be essentially the same as the in-situ pore pressure PP of the surrounding reservoir rock.

For substantially impermeable rock, such as shale and very tight non-shale, it is assumed that there is no substantial amount of pore fluid movement or filtrate invasion into the depth of cut zone. Therefore, the instantaneous pore pressure in the depth of cut zone is a function of the stress change on the rock in the depth of cut zone, rock properties such as permeability and stiffness, and in-situ pore fluid properties (primarily compressibility).

Confined compressive strength is determined based upon the unconfined compressive strength of the rock and the confining or differential pressure applied to the rock during drilling. Equation (2) represents one widely practiced and accepted "rock mechanics" method for calculating confined compressive strength of rock.

$$CCS=UCS+DP+2DP\sin FA/(1-\sin FA) \quad (2)$$

where:

UCS=rock unconfined compressive strength;

DP=differential pressure (or confining stress) across the rock; and

FA=internal angle of friction of the rock.

In the preferred and exemplary embodiment of the present invention, the unconfined compressive strength UCS and internal angle of friction FA is calculated by the processing of acoustic well log data or seismic data. Those skilled in the art will appreciate that other methods of calculating unconfined compressive strength UCS and internal angle of friction FA are known and can be used with the present invention. By way of example, and not limitation, these alternative methods of determining UCS and FA include alternative methods of processing of well log data, and analysis and/or testing of core or drill cuttings.

Theoretical details regarding the internal angle of friction can be found in U.S. Pat. No. 5,416,697, to Goodman, entitled "Method for Determining Rock Mechanical Properties Using Electrical Log Data", which is hereby incorporated by reference in its entirety. Goodman utilizes an expression for the angle of internal friction disclosed by Turk and Dearman in 1986 in "Estimation of Friction Properties of Rock from Deformation Measurements", Chapter 14, Proceedings of the 27th U.S. Symposium on Rock Mechanics, Tuscaloosa, Ala., Jun. 23-25, 1986. The function predicts that as Poisson's ratio changes with changes in water saturation and shaliness, the angle of internal friction changes. The angle of internal friction is therefore also related to rock drillability and therefore to drill bit performance. Adapting this methodology to the bottom hole drilling conditions for permeable rock is accomplished by defining differential pressure DP as equivalent circulating density ECD pressure minus the in-situ pore pressure PP. This results in the mathematical expressions for $CCS_{HP}$ and DP as described above with respect to equation (2). Equation (2) assumes that friction angle FA is linear across a range of CCS. Equations may also be used which due not make this linearity assumption for FA.

ECD pressure is most preferably calculated by directly measuring pressure with down hole tools. Alternatively, ECD pressure may be estimated by adding a reasonable value to mud pressure or calculating with software. Those skilled in the art will appreciate that other ways of determining the mud or ECD pressure may be used with the present invention to estimate CCS for a rock.

Rather than assuming the pore pressure PP in low permeability rock is essentially zero, the present invention ideally utilizes a soil mechanics methodology to determine the change in pore pressure PP and applies this approach to the drilling of rocks. For the case of impermeable rock, a relationship described by Skempton, A. W.: "Pore Pressure Coefficients A and B," *Geotechnique* (1954), Vol. 4, pp 143-147 is adapted for use with Equation (1). Skempton pore pressure may generally be described as the in-situ pore pressure PP of a porous but generally non-permeable material modified by the pore pressure change APP due to the change in average stress on a volume of the material assuming that permeability is so low that no appreciable flow of fluids occurs into or out of the material. In the present application, the porous material under consideration is the rock in the depth of cut zone and it is assumed that that permeability is so low that no appreciable flow of fluids occurs into or out of the depth of cut zone.

This differential pressure DP across the rock in the depth of cut zone may be mathematically expressed as:

$$DP=ECD-(PP+\Delta PP) \quad (3)$$

where:

DP=differential pressure across the rock;

ECD=Equivalent Circulating Density of the drilling fluid;

(PP+ΔPP)=Skempton pore pressure;

PP=Pore Pressure prior to drilling in the rock; and

ΔPP=change in pore pressure due to ECD pressure replacing earth stress.

Skempton describes two pore pressure coefficients A and B, which determine the change in pore pressure ΔPP caused by changes in applied total stress for a porous material under conditions of zero drainage. The change in pore pressure, ΔPP, is given in the general case by:

$$\Delta PP=B[(\Delta\sigma_1+\Delta\sigma_2+\Delta\sigma_3)/3+\sqrt{\tfrac{1}{2}[(\Delta\sigma_1-\Delta\sigma_2)^2+(\Delta\sigma_1-\Delta\sigma_3)^2+(\Delta\sigma_2-\Delta\sigma_3)^2]}*(3A-1)/3] \quad (4)$$

where:

A=coefficient that describes change in pore pressure caused by change in shear stress;

B=coefficient that describes change in pore pressure caused by change in mean stress;

$\sigma_1$=first principal stress;

$\sigma_2$=second principal stress;

$\sigma_3$=third principal stress; and

Δ=operator describing the difference in a particular stress on the rock before drilling and during drilling.

For a generally vertical well bore, the first principal stress $\sigma_1$ is the overburden pressure OB prior to drilling which is replaced by the ECD pressure applied to the rock during drilling, and $\sigma_2$ and $\sigma_3$ are horizontal principal earth stresses applied to the stress block. Also, $(\Delta\sigma_1+\sigma\Delta_2+\Delta\sigma_3)/3$ represents the change in average, or mean stress, and $\sqrt{\tfrac{1}{2}[(\Delta\sigma_1-\Delta\sigma_2)^2+(\Delta\sigma_1-\Delta\sigma_3)^2+(\Delta\sigma_2-\Delta\sigma_3)^2]}$ represents the change in shear stress on a volume of material.

For an elastic material it can be shown that A=⅓. This is because a change in shear stress causes no volume change for an elastic material. If there is no volume change then there is no pore pressure change (the pore fluid neither expands nor compresses). If it is assumed that the rock near the bottom of the hole is deforming elastically, then the pore pressure change equation can be simplified to:

$$\Delta PP=B(\Delta\sigma_1+\Delta\sigma_2+\Delta\sigma_3)/3 \quad (5)$$

For the case where it is assumed that $\sigma_2$ is generally equal to $\sigma_3$, then $$\Delta PP=B(\Delta\sigma_1+2\Delta\sigma_3)/3 \quad (6)$$

Equation (5) describes that pore pressure change ΔPP is equal to the constant B multiplied by the change in mean, or average, total stress on the rock. Note that mean stress is an invariant property. It is the same no matter what coordinate system is used. Thus the stresses do not need to be principal stresses. Equation (5) is accurate as long as the three stresses are mutually perpendicular. For convenience, $\sigma_Z$ will be defined as the stress acting in the direction of the well bore and $\sigma_X$ and $\sigma_Y$ as stresses acting in directions mutually orthogonal to the direction of the well bore. Equation (5) can then be rewritten as:

$$\Delta PP=B(\Delta\sigma_Z+\Delta\sigma_X+\Delta\sigma_Y)/3 \quad (7)$$

There will be changes in $\sigma_X$ and $\sigma_Y$ near the bottom of the hole. However, these changes are generally small when compared to $\Delta\sigma_Z$ and can be neglected for a simplified approach. Equation (7) then simplifies to $$\Delta PP=B(\Delta\sigma_Z)/3 \quad (8)$$

For most shale, B is between 0.8 and ~1.0. Young, soft shale have B values of 0.95 to 1.0, while older stiffer shale will be closer to 0.8. For a simplified approach that does not require rock properties, it is assumed that B=1.0. Since $\Delta\sigma_Z$ is equal to $(ECD-\sigma_Z)$ for a vertical well bore, equation (8) can be rewritten as:

$$\Delta PP=(ECD-\sigma_Z)/3 \quad (9)$$

Note that ΔPP is almost always negative. That is, there will be a pore pressure decrease near the bottom of the hole due to the drilling operation. This is because ECD pressure is almost always less than the in situ stress parallel to the well ($\sigma_Z$)

The altered pore pressure (Skempton pore pressure) near the bottom of the hole is equal to PP+ΔPP, or $PP+(ECD-\sigma_Z)/3$. This can also be expressed as:

$$PP-(\sigma_Z-ECD)/3. \quad (10)$$

For the case of a vertical well, $\sigma_Z$ is equal to the overburden stress or OB pressure which is removed due to the drilling operation.

In the case of a vertical well and most shale (not unusually hard and stiff), the change in average stress can be approximated by the term "(OB-ECD)/3".

Utilizing this assumption, the following expression can be used for generally vertical well bores wherein low permeability rock is being drilled:

$$CCS_{LP}=UCS+DP+2DP\sin FA/(1-\sin FA); \quad (11)$$

$$\text{where: DP=ECD pressure−Skempton Pore Pressure;} \quad (12)$$

$$\text{Skempton Pore Pressure}=PP-(OB-ECD)/3 \quad (13)$$

where:

OB=Overburden pressure or stress $\sigma_Z$ in the z-direction; and

PP=in situ pore pressure.

Overburden OB pressure is most preferably calculated by integrating rock density from the surface (or mud line or sea bottom for a marine environment). Alternatively, overburden OB pressure may be estimated by calculating or assuming average value of rock density from the surface (or mud line for marine environment). In this preferred and exemplary embodiment of this invention, Equations (2) and (11) are used to calculate confined compressive strength for high and low permeability rock, i.e. "$CCS_{HP}$" and "$CCS_{LP}$". For intermediate values of permeability, these values are used as "end points" and "mixing" or interpolating between the two endpoints is used to calculate CCS for rocks having an intermediate permeability between that of low and high permeability rock. As permeability can be difficult to determine directly from well logs, the present invention preferably utilizes effective porosity $\phi_e$. Effective porosity $\phi_e$ is defined as the porosity fraction of the non-shale fraction of rock multiplied by the fraction of non-shale rock. Effective porosity $\phi_e$ of the shale fraction is zero. It is recognized that permeability could be used directly when/if available in place of effective porosity in the methodology described herein.

Although there are exceptions, it is believed that effective porosity $\phi_e$ generally correlates well with permeability and, as such, effective porosity threshold $\phi_e$ is used as a means to quantify the permeable and impermeable endpoints. The following methodology is preferably employed to calculate "$CCS_{MIX}$", the confined compressive strength of the rock to the drill bit:

$$CCS_{MIX}=CCS_{HP} \text{ if } \phi_e \geqq \phi_{HP}, \quad (14)$$

$$CCS_{MIX}=CCS_{LP} \text{ if } \phi_e \leqq \phi_{LP}, \quad (15)$$

$$CCS_{MIX}=CCS_{LP}\times(\phi_{HP}-\phi_e)/(\phi_{HP}-\phi_{LP})+CCS_{HP}\times(\phi_e-\phi_{LP})/(\phi_{HP}-\phi_{LP})$$

$$\text{if } \phi_{LP} \leqq \phi_e \leqq \phi_{HP}; \quad (16)$$

where:

$\phi_e$=effective porosity;

$\phi_{LP}$=low permeability rock effective porosity threshold; and $\phi_{HP}$=high permeability rock effective porosity threshold.

In this exemplary embodiment, a rock is considered to have low permeability if it's effective porosity $\phi_e$ is less than or equal to 0.05 and to have a high permeability if its effective porosity $\phi_e$ is equal to or greater than 0.20. This results in the following values of $CCS_{MIX}$ in this preferred embodiment:

$$CCS_{MIX}=CCS_{HP} \text{ if } \phi_e \geqq 0.20; \quad (17)$$

$$CCS_{MIX}=CCS_{LP} \text{ if } \phi_e \leqq 0.05; \quad (18)$$

$$CCS_{MIX}=CCS_{LP}\times(0.20-\phi_e)/0.15+CCS_{HP}\times(\phi_e-0.05)/0.15 \text{ if } 0.05<\phi_e<0.20. \quad (19)$$

As can be seen from the equations above, the assumption is made that the rock behaves as impermeable if $\phi_e$ is less than or equal to 0.05 and as permeable if $\phi_e$ is greater than or equal to 0.20. The endpoint $\phi_e$ values of 0.05 and 0.20 are assumed, and it is recognized that reasonable endpoints for this method are dependent upon a number of factors including the drilling rate. Those skilled in the art will appreciate that other endpoints may be used to define the endpoints for low and high permeability. Likewise, it will be appreciated that non-linear interpolation schemes can also be used to estimate $CCS_{MIX}$ between the endpoints. Further, other schemes of calculating $CCS_{MIX}$ for a range of permeabilities may be used which rely, in part, upon the Skempton approach described above for calculating pore pressure change ΔPP which is generally mathematically described using Equations (4-9).

Calculations for CCS may be modified to account for factors such as (1) the deviated angle from vertical at which the well bore is being drilled, (2) stress concentrations in the depth of cut zone; and (3) effects of the profile or shape of the well bore due to the geometry of the drill bit being used to create the well bore. These calculations are described in co-pending patent application entitled, "Method for Estimating Confined Compressive Strength for Rock Formation Utilizing Skempton Theory".

Figure 4:
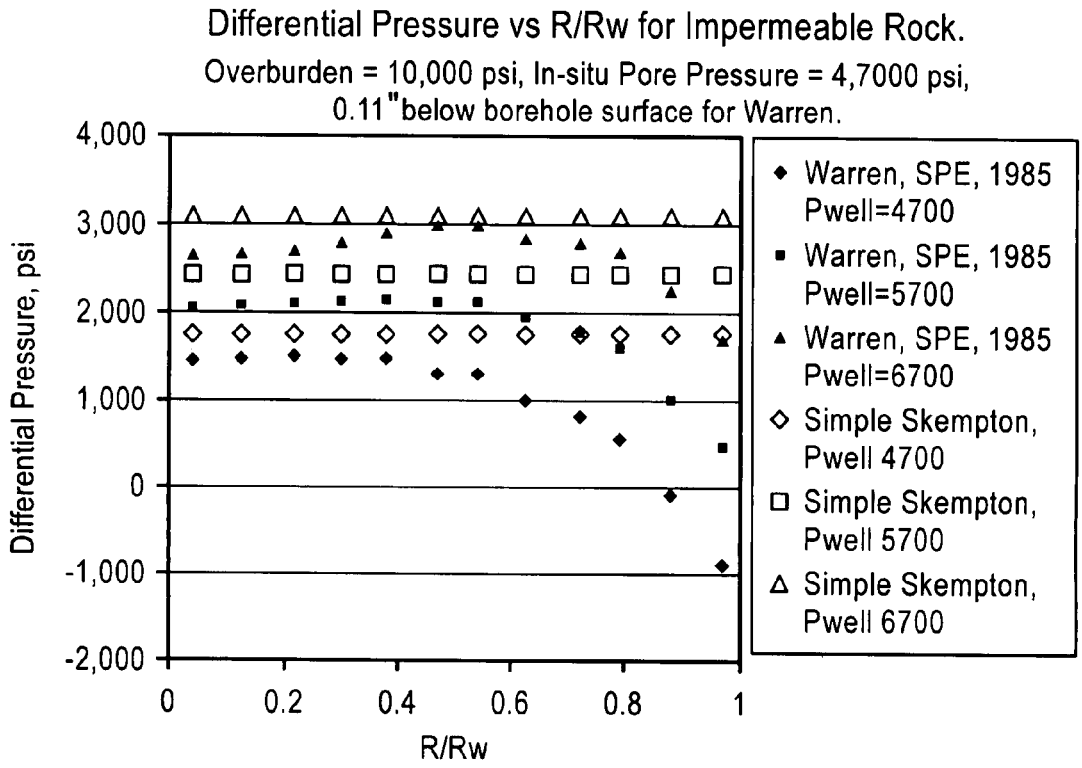
FIG. 4 is a graph of differential pressure applied to rock in the depth of cut zone versus radial position at the bottom of a hole for impermeable rock using calculated values of confined compressive strength CCS and values of CSS determined using a finite element model.

FIG. 4 illustrates that using Skempton theory in conjunction with equation (3) produces values for differential pressure DP that corresponds well with differential pressure DP arrived at using a finite element modeling. The finite element model and results corresponding to FIG. 4 are described in Warren, T. M., Smith, M. B.: "Bottomhole Stress Factors Affecting Drilling Rate at Depth," *J. Pet Tech*. (August 1985) 1523-1533.

While the above description provides the preferred mode for calculating CCS, those skilled in the art will appreciate that other methods of determining CCS may also be used in conjunction with this invention to calculate ROP and make other estimations based on CCS of rocks. By way of example, and not limitation, one alternative method of how to determine CCS is described in U.S. Pat. No. 5,767,399 to Smith and Goldman, entitled "Method of Assaying the Compressive Strength of Rock".

III. Determination of ROP Based Upon Specific Energy Principles

A methodology has been developed for quantitative prediction of the input variables to a specific energy ROP model, except bit size as bit size is known or given, based on apparent rock strength to the bit. This allows rapid prediction of the expected range of ROP and drilling parameters (WOB, rpm, torque) for all bit types, according to rock properties and the drilling environment, i.e., (mud weight and ECD).

Specific energy (Es) principles provide a means of predicting or analyzing bit performance. Es is based on fundamental principles related to the amount of energy required to destroy a unit volume of rock and the efficiency of bits to destroy the rock. The Es parameter is a useful measure for predicting the power requirements (bit torque and rpm) for a particular bit type to drill at a given ROP in a given rock type, and the ROP that a particular bit might be expected to achieve in a given rock type.

Teale, R.: "The Concept of Specific Energy in Rock Drilling," *Int. J. Rock Mech. Mining Sci*. (1965) 2, 57-53, describes the use of specific energy theory in assessing bit performance. Equation 20 shows Teale's specific energy equation derived for rotary drilling at atmospheric conditions.

$$Es = \frac{WOB}{A_B} + \frac{120*\pi*N*T}{A_B*ROP} \quad (20)$$

where:

Es=Specific energy (psi)

WOB=Weight on bit (pounds)

$A_B$=Borehole area (sq-in)

N=rpm

T=Torque (ft-$lb_f$)

ROP=Rate of penetration (ft/hr)

WOB=Weight on bit (pounds)

Pessier, R. C., Fear, M. J.: "Quantifying Common Drilling Problems with Mechanical Specific Energy and Bit-Specific Coefficient of Sliding Friction," paper SPE 24584 presented at 1992 SPE Conference, Washington, D.C., October 4-7, validated Equation (1) for drilling under hydrostatic pressure.

Because the majority of field data is in the form of surface measurements of weight on bit (WOB), rpm (N), and rate of penetration (ROP), a bit-specific coefficient of sliding friction (μ) was introduced by Teale to express torque (T) as a function of WOB. This coefficient is used to compute specific input energy (Es) values in the absence of reliable torque measurements, as follows:

$$\mu = 36\frac{T}{D_B*WOB} \quad (21)$$

where:

T=bit torque (ft-$lb_f$);

$D_B$=bit size (inches);

μ=bit-specific coefficient of sliding friction (dimensionless); and

WOB=weight on bit (lb).

Teale also introduced the concept of minimum specific energy and maximum mechanical efficiency. The minimum specific energy is reached when the specific energy approaches or is roughly equal to the compressive strength of the rock being drilled. The mechanical efficiency ($EFF_M$) for any bit type is then calculated as follows:

$$EFF_M = \frac{Es\ \min}{Es} * 100 \tag{22}$$

where: Es min=Rock Strength

The associated bit torque for a particular bit type to drill at a given ROP in a given rock type (CCS) is computed by using equation (23), which is derived from equation (20) and equation (22), as follows:

$$T = \left(\frac{CCS}{EFF_M} - \frac{4 * WOB}{\pi * D_B^2}\right) * \left(\frac{D_B^2 * ROP}{480 * N}\right) \tag{23}$$

Substituting Es in terms of mechanical efficiency $EFF_M$ and torque T as a function of WOB and solving equation (20) for ROP, the rate of penetration can be calculated using equation (1) as described above.

Specific Energy ROP (SEROP) Model

The present invention ideally predicts the coefficients required in Equation (1) as a function of rock strength CSS. These predictions of coefficients are performed for a number of predominant bit types, including steel tooth, insert tooth, PDC, TSP, impregnated, and natural diamond bit types. More particularly, relationships for (1) the coefficient of sliding friction μ and (2) the 8 mechanical efficiency $EFF_M$, and preferably for (3) WOB, and (4) bit speed N is determined for a number of types of bits as a function of apparent rock strength or CCS to the bit.

Equation (1) is used to calculate ROP for multiple bit types. Ideally, three ROPs are calculated for each bit type: a minimum ROP, a maximum ROP, and an average or nominal ROP. These computations are possible because three mechanical efficiencies (minimum efficiency, maximum efficiency, and nominal efficiency) are determined from the full-scale simulator tests for each bit type.

Full-Scale Simulator Tests

Full-scale simulator tests were conducted at Hughes Christensen facilities in the Woodlands, Texas using a pressurized vessel test rig to determine sliding coefficient of friction μ and mechanical efficiency $EFF_M$ for a select number of types of drill bits. Detailed information about this facility and full-scale simulator test procedures can be found in the 1999 ASME ETCE99-6653 technical paper titled "Re-Engineered Drilling Laboratory is a Premium Tool Advancing Drilling Technology by Simulating Downhole Environments".

The drilling simulator, which is capable of testing bits up to 12¼" in diameter, reproduces downhole conditions. It is equipped with a high-pressure drilling simulator and uses full-scale bits. The laboratory is capable of re-creating the geostatic stresses in the well bore at equivalent drilling depths of up to 20,000 ft with typical drilling fluids.

Drilling parameters, weight on bit WOB, rotary speed N, rate of penetration ROP, torque T, and bit hydraulics are computer controlled and/or recorded throughout the individual test. Typically torque T is recorded. One of two variables WOB and ROP are controlled with the other being a measured response. This data is then used to compute bit-specific coefficient of sliding friction (μ), mechanical efficiency ($EFF_M$), and specific energy (Es) for each test and bit type.

Rock samples with confined compressive strength ranging from 5,000 to 75,000 psi were used to develop the relationships for μ, and $EFF_M$ as a function of confined compressive strength (CCS) for all bit types.

The following rock samples were used:

Catoosa Shale
Mancos Shale
Carthage Marble
Crab Orchard Sandstone
Mansfield Sandstone From this test, three points are derived to develop the relationships for μ and $EFF_M$ for an 8½" roller cone bit for hard formations. These points are:

μ=0.11 at 66,000 psi
Minimum $EFF_M$=19% at 66,000 psi
Maximum $EFF_M$=44% at 66,000 psi
CCS=66,000 psi Bit Types in the ROP Model The following bit types were tested:

Steel Tooth bits (ST);
Tungsten Carbide Insert bits (TCI_SF) for soft formations;
Tungsten Carbide Insert bits (TCI_MF) for medium formations;
Tungsten Carbide Insert bits (TCI_HF) for hard formations;
Polycrystalline Diamond Compact bits (PDC):
PDC bits with 3 to 4 blades;
PDC bits with 5 to 7 blades;
PDC bits with more than 7 blades;
Natural Diamond bits (ND);
Impregnated bits (IMPREG);
Thermally Stable Polycrystalline bits (TSP);
Universal Roller Cone bits (ST and TCI bits);
Universal PDC bits (all PDC bits); and
Universal ND and TSP bits.

Figure 5:
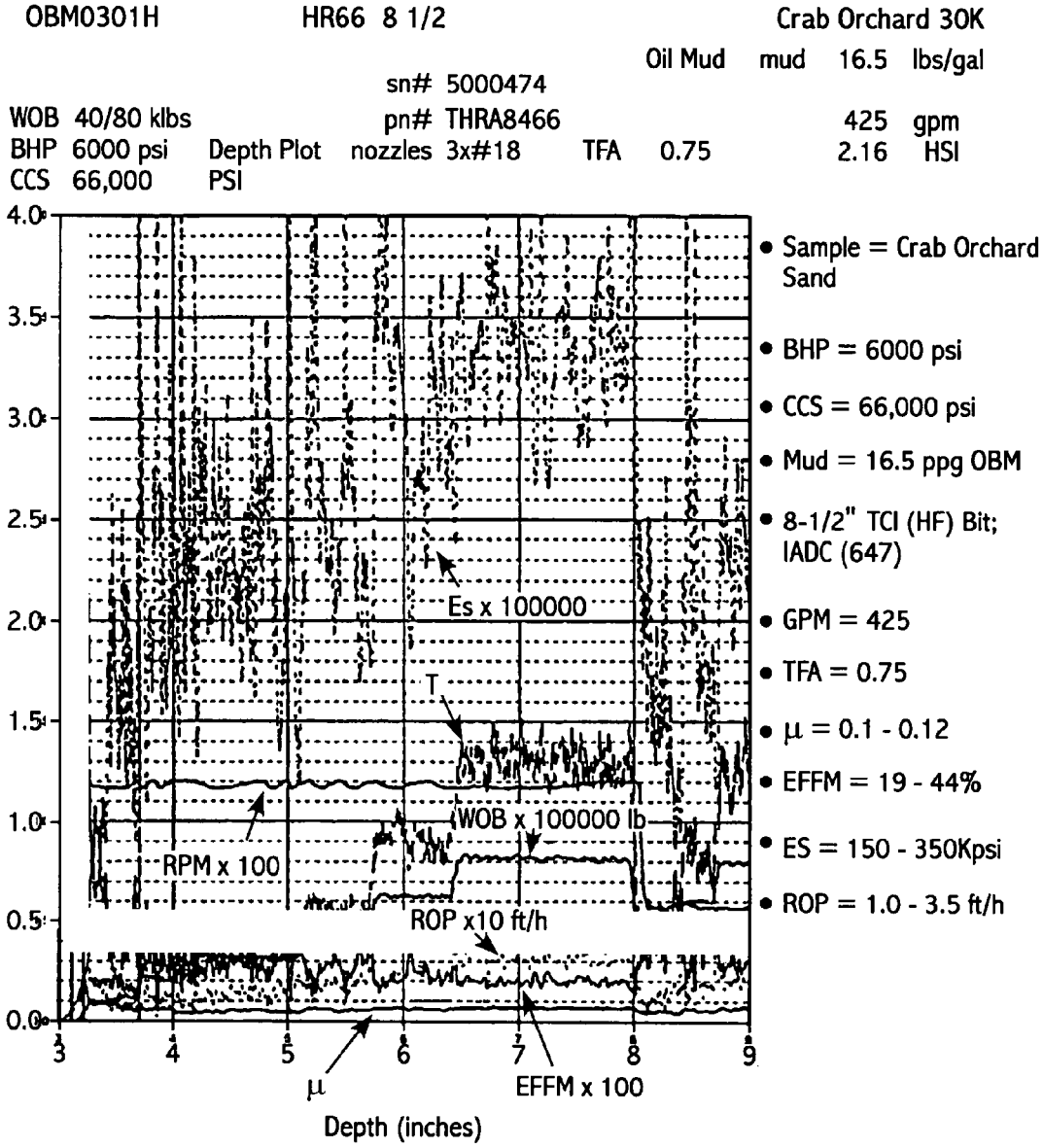
FIG. 5 is a chart produced during a full-scale simulator test for a roller insert bit for hard formations.

FIG. 5 shows data from one of the tests conducted to determine bit coefficient of sliding friction μ, mechanical efficiency $EFF_M$, and specific energy for a particular combination of bit type, environment, and confined rock strength CCS. The test data shown in FIG. 5 provided values for torque at several WOB/ROP pairs for a given bit type and CCS, and from which Es, μ and $EFF_M$ are calculated.

Bit-Specific Coefficient of Sliding Friction (μ)

Figure 6:
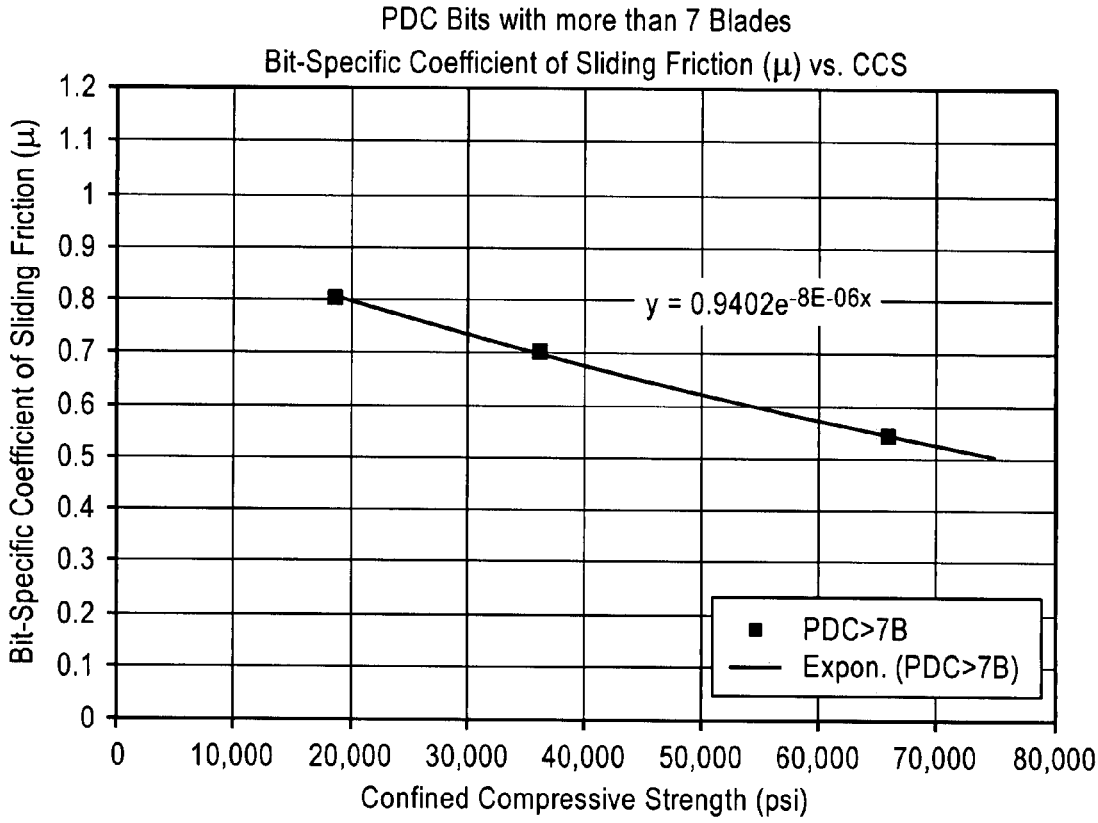
FIG. 6 is a graph of a bit-specific coefficient of sliding friction μ as a function of CCS for PDC bits with more than seven blades.

An example of how a relationship between a bit-specific coefficient of sliding friction μ and confined compressive strength CCS is determined from multiple tests is illustrated in FIG. 6. In this case the bit is a PDC bit with more than seven blades. Rock samples from Crab Orchard Sandstone, Catoosa shale, and Carthage Marble were used for multiple tests with a PDC bit with more than seven blades. All tests used a mud weight of 9.5 ppg. The corresponding CCS values at 6,000 psi bottom hole pressure were 18,500 psi for Catoosa shale, 36,226 psi for Carthage Marble, and 66,000 psi for Crab Orchard.

The correlation established from this test data and then used to compute μ as a function of CCS for a PDC bit with more than seven blades, derived from FIG. 6, is shown in equation (24).

$$\mu = 0.9402 * EXP(-8E-06 * CCS) \tag{24}$$

The same procedure and full-scale simulator tests were performed to determine the relationships of μ as a function of confined compressive strength CCS for all bit types.

Mechanical Efficiency (EFFM)

As shown in FIG. 5, Es changes as drilling parameters change. Consequently, Es can not be represented by a single accurate number. Minimum and maximum values of Es were computed from each full-scale simulator test, and these values were used to compute minimum and maximum mechanical efficiencies for each test. For example, the test data from FIG. 5 indicates a mechanical efficiency in the range of approximately 19% to 44% for this test.

Figure 7:
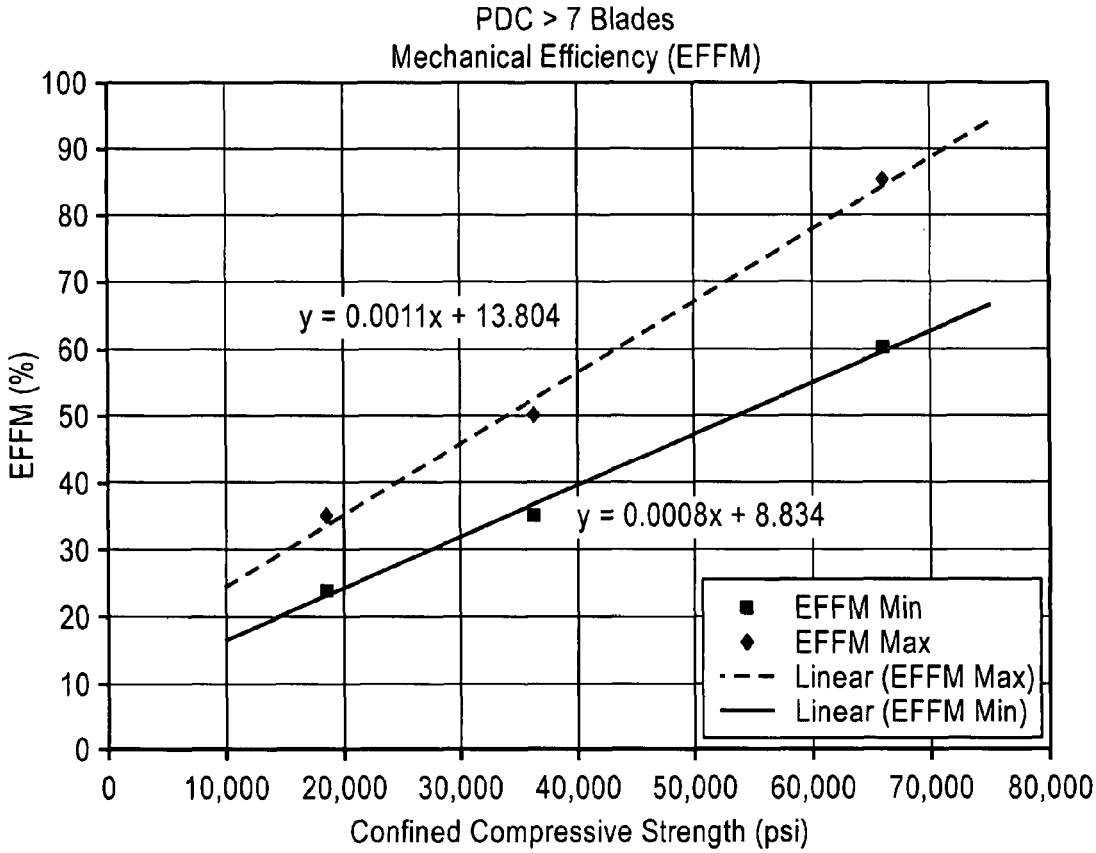
FIG. 7 is a graph of minimum and maximum mechanical efficiencies $EFF_M$ as a function of CCS for PDC bits with more than seven blades.
Figure 8:
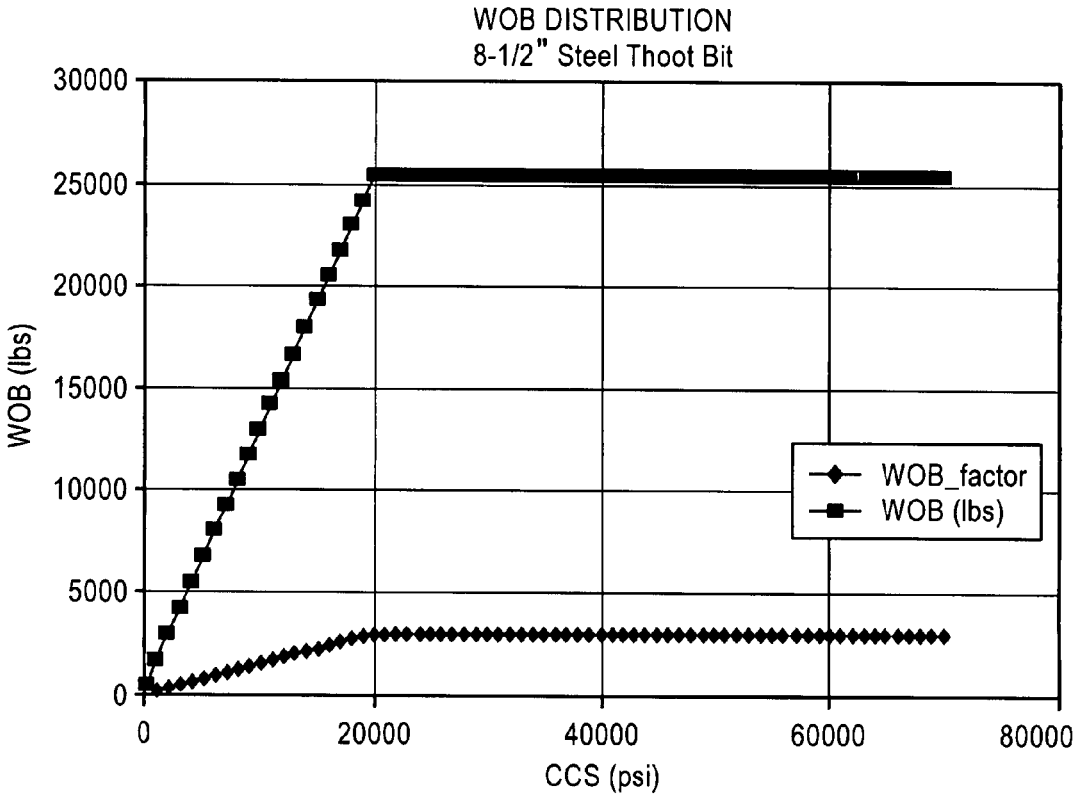
FIG. 8 is a graph of weight on bit WOB and WOB factor (lbs per inch bit diameter) versus CCS for an 8.5" steel tooth bit type.

FIG. 7 illustrates the relationships of minimum and maximum mechanical efficiencies for PDC bits with more than seven blades as derived from test data. The relationships derived from FIG. 7 and shown in Equations (25) and (26) are then used to compute the minimum efficiency (Min $EFF_M$) and maximum efficiency (Max $EFF_M$) as a function of CCS for PDC bits with more than seven blades are as follows:

$$\text{Min}EFF_M=0.0008*\text{CCS}+8.834$$

$$\text{Max}EFF_M=0.0011*\text{CCS}+13.804 \quad (25 \text{ and } 26)$$

A nominal mechanical efficiency (Nom $EFF_M$) is the average efficiency derived from the minimum and maximum efficiencies. Equation (27) indicates the Nom $EFF_M$ for PDC bits with more than seven blades.

$$NomEFF_M=0.00095*\text{CCS}+10.319 \quad (27)$$

Similar procedures and testing methods were applied to determine the mechanical efficiencies, minimum, maximum and nominal, for all bit types. These correlations are not shown in this application.

Weight on Bit (WOB) and Bit rpm

Drilling parameters WOB and N are variables that are selected based on a number of factors, including but not limited to field experience, bit type, and/or bottom hole (BHA) configuration. However, the present invention also has the capability of predicting the appropriate WOB and N based on CCS.

Figure 9:
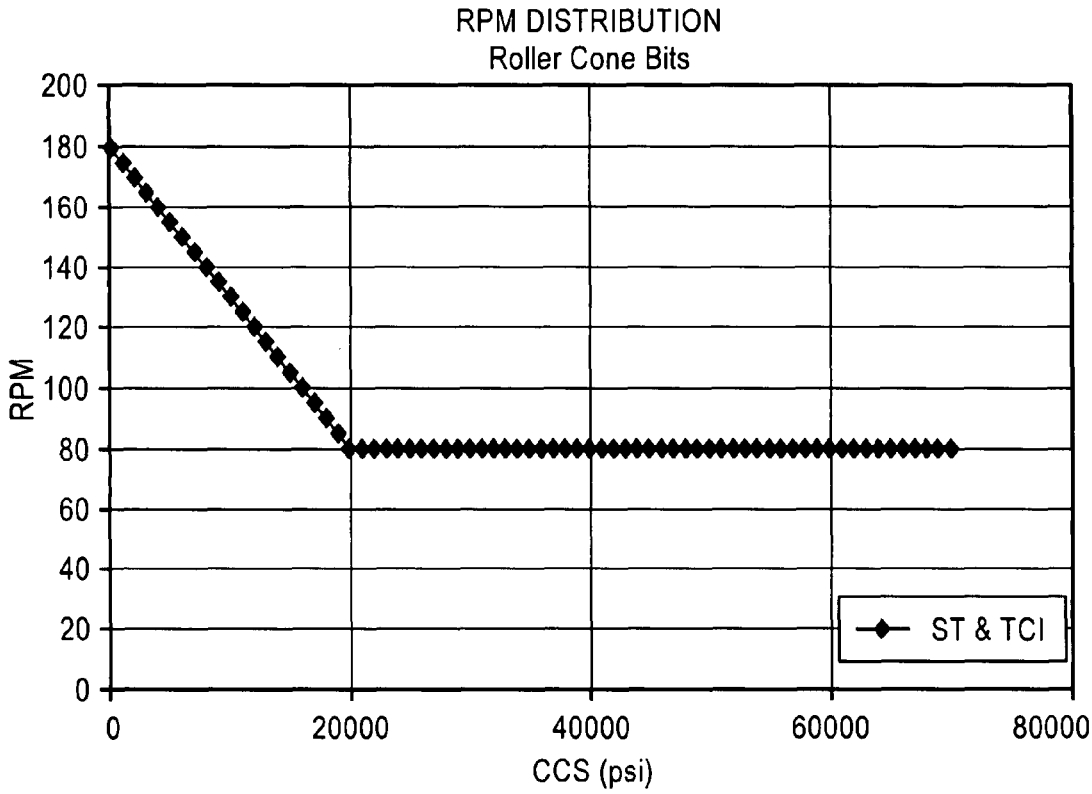
FIG. 9 is a graph of rotary drill speed N (RPM) versus CCS for roller cone bits.

FIG. 9 shows the relationship between WOB factor (pounds force per inch of bit diameter) and CCS, and the relationship between WOB for an 8.5" steel tooth bit and CCS. FIG. 9 shows the relationship between N (RPM for roller cone bits) and CCS.

Adjustments to μ and $EFF_M$ Due to Drilling Environment

The efficiency of drill bits is affected by mud weight. The magnitude of efficiency change arising from changes in mud weight has been determined by performing additional tests that use different mud weight systems. Because full-scale simulator tests for all bit types were performed using a 9.5 ppg mud weight, the potential effect of mud weight on μ and $EFF_M$ was evaluated using a heavier mud weight. Consequently, full-scale tests were performed for all bit types using a 16.5 ppg mud weight.

Figure 10:
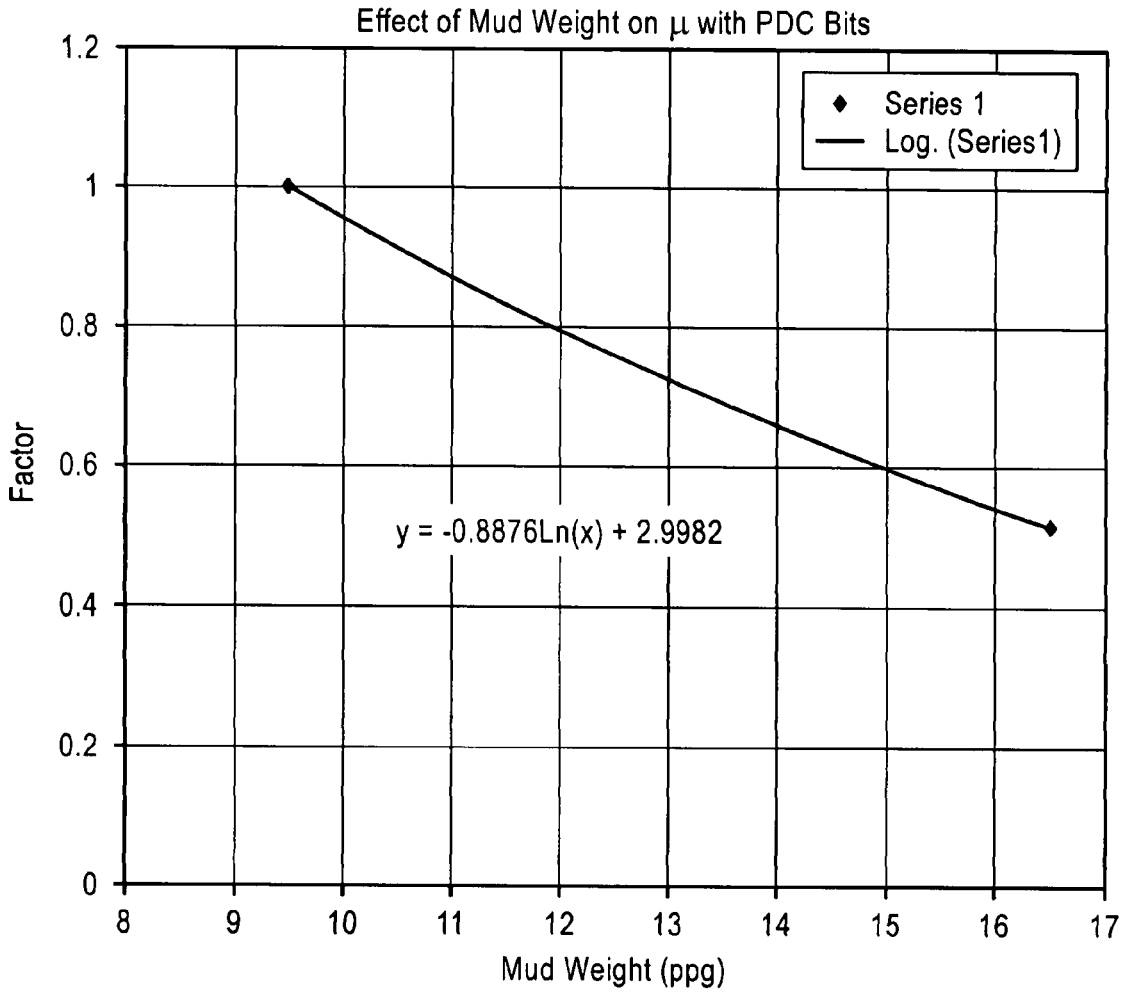
FIG. 10 is a graph of a correction factor for coefficient of sliding friction μ versus mud weight for PDC bits.

It has been determined that the value of μ for PDC bits is reduced by approximately 49% when increasing mud weight from 9.5 ppg to 16.5 ppg. As a result, the value of μ is preferably corrected if the mud weight is different from 9.5 ppg. From FIG. 10, the following correction factor for coefficient of sliding friction μ for PDC bits with more than seven blades was established.

$$CF_\mu=-0.8876*\text{Ln(mud weight)}+2.998 \quad (28)$$

Equation (29) is a revised formula for computing the value of μ for any mud weight.

$$\mu=[(0.9402*\text{EXP}(-8E-06*\text{CCS})]*[-0.8876*\text{Ln(Mud-Weight)}+2.998] \quad 29)$$

Figure 11:
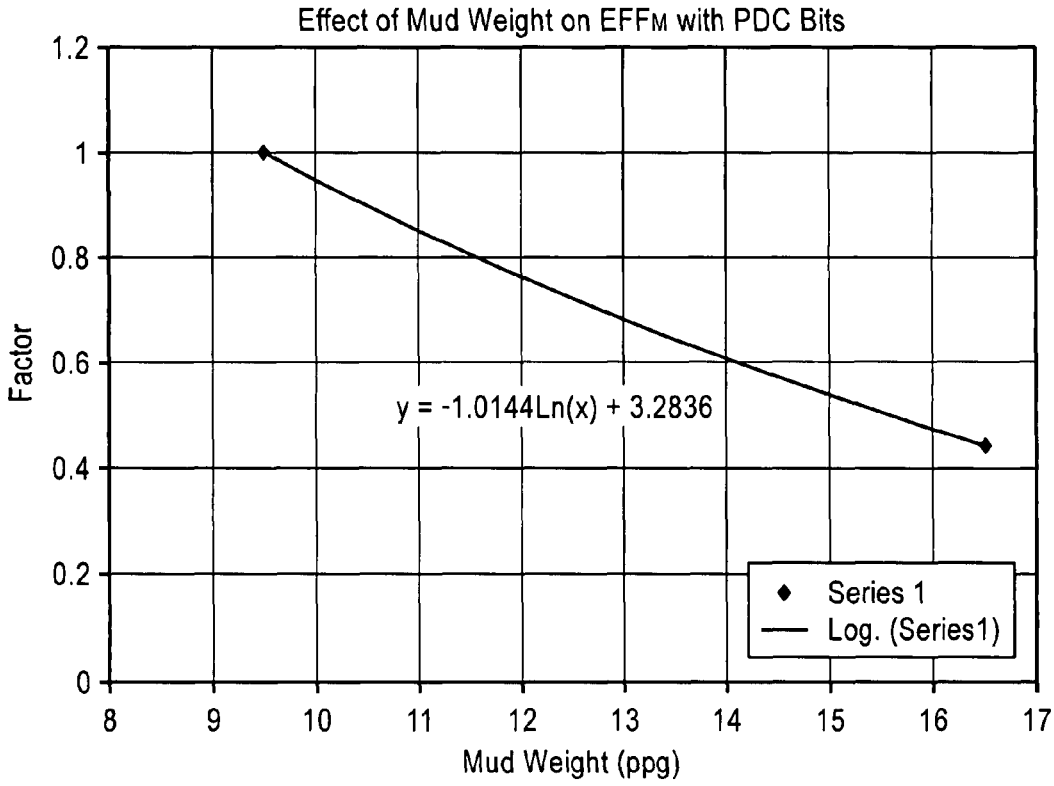
FIG. 11 is a graph of a correction factor for mechanical efficiency $EFF_M$ versus mud weight for PDC bits.

It was determined that mechanical efficiency for PDC bits was reduced by approximately 56% when increasing the mud weight from 9.5 ppg to 16.5 ppg. FIG. 11 establishes the following correction factor to $EFF_M$ for PDC bits with more than seven blades:

$$CF_{EFFM}=-1.0144*\text{LN(Mud Weight)}+3.2836 \quad (30)$$

Equations (31) and (32) show the revised correlations for Min and Max mechanical efficiencies for PDC bits with more than seven blades.

$$\text{Min}EFF_M=[-0.0008*\text{CCS}+8.8349]*[1.0144*\text{Ln(Mud Weight)}+3.2836] \quad (31)$$

$$\text{Max}EEF_M=[-0.0011*\text{CCS}+13.804]*[1.0144*\text{LnMud Weight)}=3.2836] \quad (32)$$

The same testing procedure was conducted to establish the correction factors for μ and $EFF_M$ for all bit types. Although the above equations are linear, as are the curves shown in FIGS. 10 and 11, it is recognized that non-linear relationships may, in fact, be valid and more realistic. Accordingly, those skilled in the art may preferably employ such non-linear equations/relationships when appropriate.

Correction Factor for PDC Bits Due to Cutter Size

Figure 12:
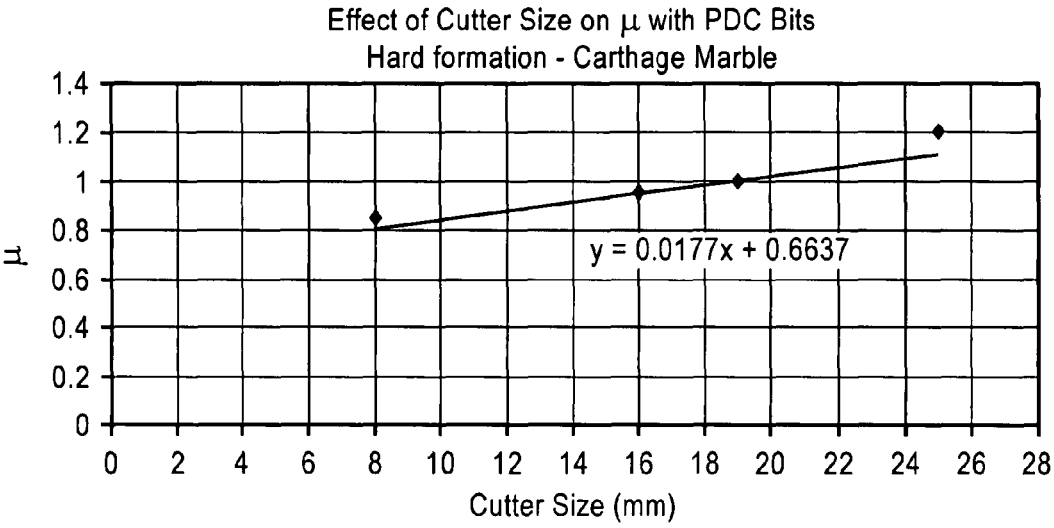
FIG. 12 is a graph of a correction factor for coefficients of sliding friction μ which is dependent upon cutter size for PDC bits.

To account for the effect of cutter size for PDC bits in the ROP model, full-scale simulator tests were performed using various cutter sizes with PDC bits. FIG. 12 illustrates the effect of cutter size with PDC bits. Because full-scale simulator tests for PDC bits were performed using drill bits with 19 mm cutters, additional tests were performed with cutter size greater than or less than 19 mm. The test results indicated that the bit coefficient of sliding friction μ is decreased or increased by 1.77% when the cutter size is decreased or increased for each millimeter above or below 19 mm, as shown in FIG. 12.

Therefore, the correction factor to adjust μ due to cutter size is as follows:

$$0.0177*\text{Cutter Size}+0.6637 \quad (33)$$

where: cutter size is in millimeters.

Although the above equation indicates a linear relationship, it is recognized that non-linear relationships may, in fact, be valid and more realistic, and may preferably be employed when appropriate. This, in fact, is indicated by FIG. 11.

Combining all the correction factors, the final correlation for μ for PDC bits with more than seven blades is shown in equation (34).

$$\mu=[(0.9402*\text{EXP}(-8E-06*\text{CCS})]*[-0.8876*\text{Ln(Mud-Weight)}+2.998]*[0.0177*\text{Cutter Size}+0.6637] \quad (34)$$

In a similar manner, final correlations for p for all bit types may be made for other bit types.

Limitations of ROP Model

The above described ROP model based upon specific energy does not take into account bit design features, such as cone offset angle, cone diameter, and journal angle of roller cone bits, and does not take into account design features, such as back rack angle and bit profile of PDC bits. The selection of the proper bit design features for each application could impact ROP. Although the impact on ROP of all design features is quantitatively measured in the lab, field tests using the subject ROP model indicate that the impact on ROP could be between 10% and 20%. The variation of ROP as a result of bit design features is assumed to be captured by the ROP model because it computes a maximum and a minimum ROP as a function of maximum and minimum efficiency. In fact, in most of the field examples, the nominal ROP closely correlates with actual ROP, but there are a few cases in which either the minimum or the maximum ROP correlate with actual ROP.

Mud systems, such as water based mud (WBM) or oil based mud/synthetic based mud (OBM/SBM), are not differentiated in the specific energy ROP model. However, field tests show that a significant factor affecting bit performance and ROP is bit balling with WBM. If bit balling is eliminated with optimum hydraulics and control of mud properties, it is assumed the predicted ROP will be approximately the same for both mud systems.

The specific energy ROP model does not consider or optimize hydraulics. Full scale simulator tests used to develop the ROP model were performed with optimum hydraulics. Again, because the specific energy ROP model predicts minimum and maximum ROP, the actual ROP typically falls within the minimum and maximum ROP parameters for any bit type, provided that the actual hydraulics are adequate.

The ROP model of the present invention is currently adapted only for sharp bits. It does not take into account bit wear. However, ROP model may be further adjusted for bit wear as bit wear and/or bit life models may be developed. Examples of how bit wear and bit life may be incorporated into drilling predictions are described in U.S. Pat. No. 6,408,953 to Goldman, entitled "Method and System for Predicting Performance of a Drilling System for a Given Formation". The disclosure of this patent is hereby incorporated by reference in its entirety.

Predicted ROP for PDC bits is for groups of bits based on blade count. Three groups were established: PDC bits with three to four blades, PDC bits with five to seven blades, and PDC bits with more than seven blades. Field tests indicate that minimum ROP generally correlates with PDC bits with the highest number of blades within the group and maximum ROP correlates with the lowest blade count in the group.

Predicted ROP for roller cone bits was made for four groups of bits: steel tooth bits, roller insert bits for soft formations, roller insert bits for medium formations, roller insert bits for hard formations.

The specific energy ROP model doesn't account for when the CCS might exceed the maximum CCS suitable for a particular bit type. As a result, with the exception of very high strength rock, the specific energy ROP model generally predicts that the highest ROP for a PDC bit with three to four blades, the next highest ROP for a PDC bit with five to seven blades, and so forth, through the range of different bit types according to aggressiveness.

Bit Selection and Optimization

The most common approach for evaluating drilling performance and bit selection in the oil field is based on past observed performance from offset wells. This methodology tends to apply the same drilling performance and rock strength to the current application without evaluating changes in rock strength, lithology, drilling environment, and potential ROP if other bit types are used. The CCS and specific energy ROP models use rock properties and drilling environments to accurately predict the potential ROP for all bit types.

Therefore, the present approach is global; it is not restricted to a particular area or region nor does it necessarily require calibration to local conditions.

In a real-time bit optimization scenario, predicted ROP and Es energy values can be used to assess bit performance. This can be accomplished if the rock properties are known, either by correlation or directly measured and calculated from LWD (logging while drilling) data or from drilling parameters as indicated in section IV below. Bit performance and condition can be evaluated by comparing actual Es to predicted Es, as well as by comparing actual ROP to predicted ROP. Bit performance analysis using real time predicted Es and actual Es values can be also used to detect and correct drilling problems, such as bit vibration and bit balling. Predicted and actual Es values can also be used in dull bit and/or bit failure analysis.

IV. Back Calculation of UCS

The specific energy ROP and CCS models described above can be used to back calculate CCS and rock properties in the absence of log or other data. The rock properties can then be used for real-time bit optimization, wellbore stability and sanding or post-drill bit optimization, wellbore stability and sanding or post-drill bit optimization, wellbore stability and sanding analysis. Assuming drilling parameters are obtained during drilling, values of CCS can be determined as follows: downhole torque and WOB are available from downhole tools, bit-specific coefficient of sliding friction can be calculated using equation (21):

$$\mu = 36\frac{T}{D_B * WOB}$$

Once the bit-specific coefficient of sliding friction has been determined using equation (21), the confined compressive strength of the rock being drilled (CCS) is determined by using the relationships between bit-specific coefficient of sliding friction μ and confined compressive strength CCS determined for all bit types (e.g. relationship in FIG. 6).

Once CCS is determined, the mechanical efficiency $EFF_M$ for any bit type is derived from the relationships between minimum and maximum mechanical efficiency (e.g. relationship in FIG. 7). Knowing CCS, the ROP for any bit type can be calculated using equation (1) for a given set of drilling parameters (WOB and N).

In the absence of downhole torque, μ can be calculated by trial and error methods until predicted ROP match with actual ROP. $EFF_M$ can be determined using average values of $EFF_M$ or determined by trial and error methods until predicted ROP matches with actual ROP. Then CCS can be calculated using equation (1). Further UCS can be back calculated from the CCS using equation (2). Once UCS is determined, this value of UCS can be used in well bore stability and sanding analysis.

Examples

The field test examples presented below illustrate how the CCS and specific ROP models may be used to improved drilling performance by reducing both drilling time and drilling costs. This performance is achieved by selecting the optimum drill bits and drilling parameters for each application.

Well 1

Figure 13:
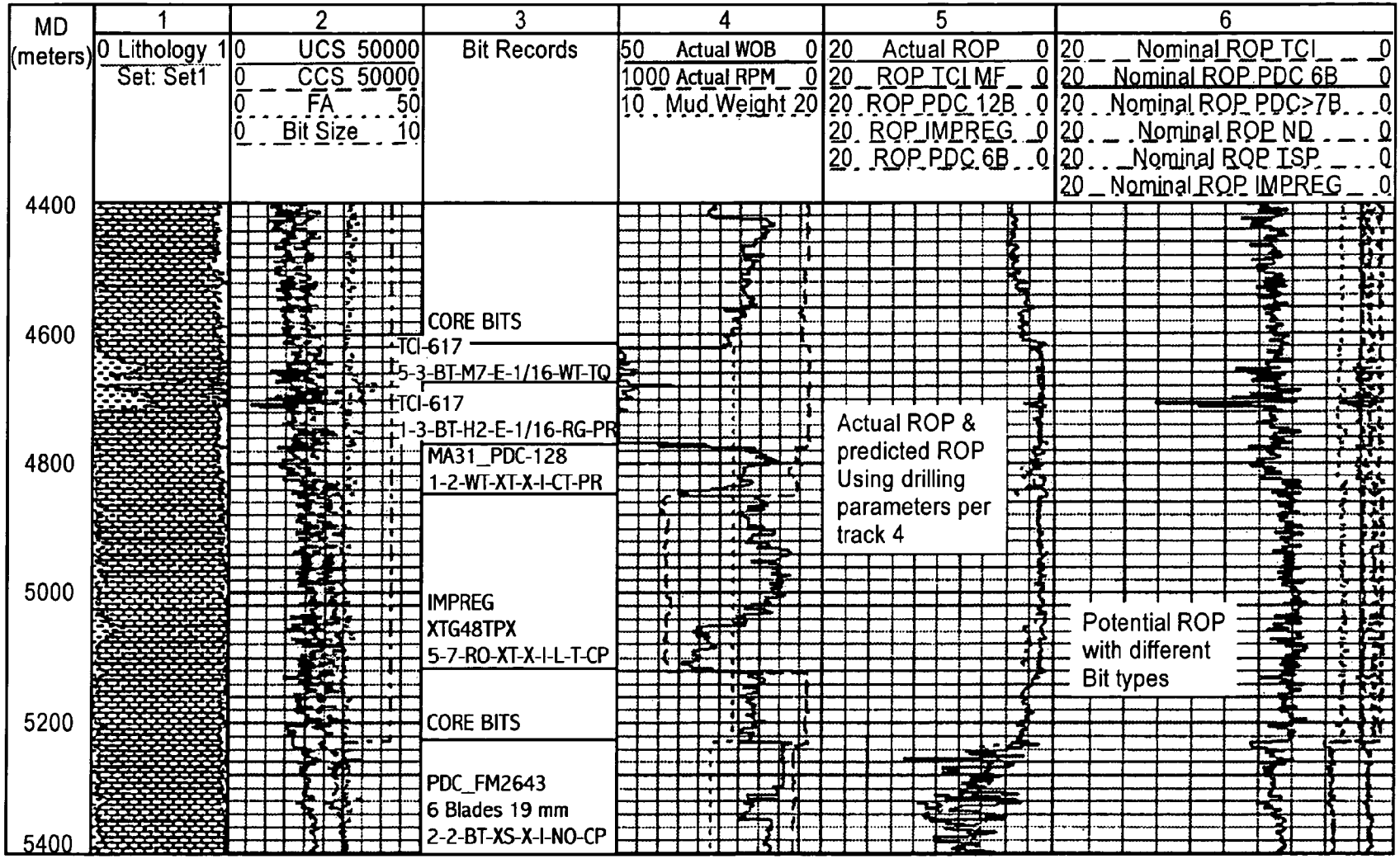
FIG. 13 is chart of a bit optimization and selection for a first well.

FIG. 13 shows the drilling performance for a specific interval composed mainly of dolomite in which the ROP has been very low (approximately 1 meter/hour) with roller cone bits (TCI), heavy set PDC bits, and impregnated bits (IMPREG). Analysis indicates that CCS ranged from about 20,000 psi to 35,000 psi.

Track 5 provides an example of the correlation between the predicted ROP to the actual ROP for all bit types used to drill the interval. Predicted ROP is calculated using actual drilling parameters (WOB, RPM) from actual bit runs shown in Track 4. Track 3 shows the actual bits used and their dull grades. Track 6 illustrates the potential ROP for Insert bits (TCI medium formations), PDC bits with five to seven blades and 19 mm cutters (PDC 5-7B), PDC bits with more than seven blades (PDC>7B), Natural Diamond (ND) bits, Thermally Stable Polycrystalline (TSP) bits, and Impregnated (IMPREG) bits. The predicted ROP for ND, TSP, and IMPREG bits is calculated using global defaults in the specific energy ROP model.

The analysis suggested that neither roller cone bits nor Impreg bits are suitable for this application because of low ROP. The analysis indicated that PDC bits with five to seven blades and 19 mm cutters could deliver a ROP between 6 and 8 meters per hour (WOB between 10 and 20 Klbs and N between 120 and 160 rpm). Although, a PDC bits with three to four blades will deliver a higher ROP (not shown here), this bit was not considered because the high rock strength exceeds the bits rock strength capability. As a result, the recommended approach is to use a six bladed PDC bit with 19 mm abrasive resistance cutters and thinner diamond tables (less than 0.120 inches thickness). Wells can now be drilled at an average ROP of 6 to 8 meters per hour.

Well 2

Figure 14:
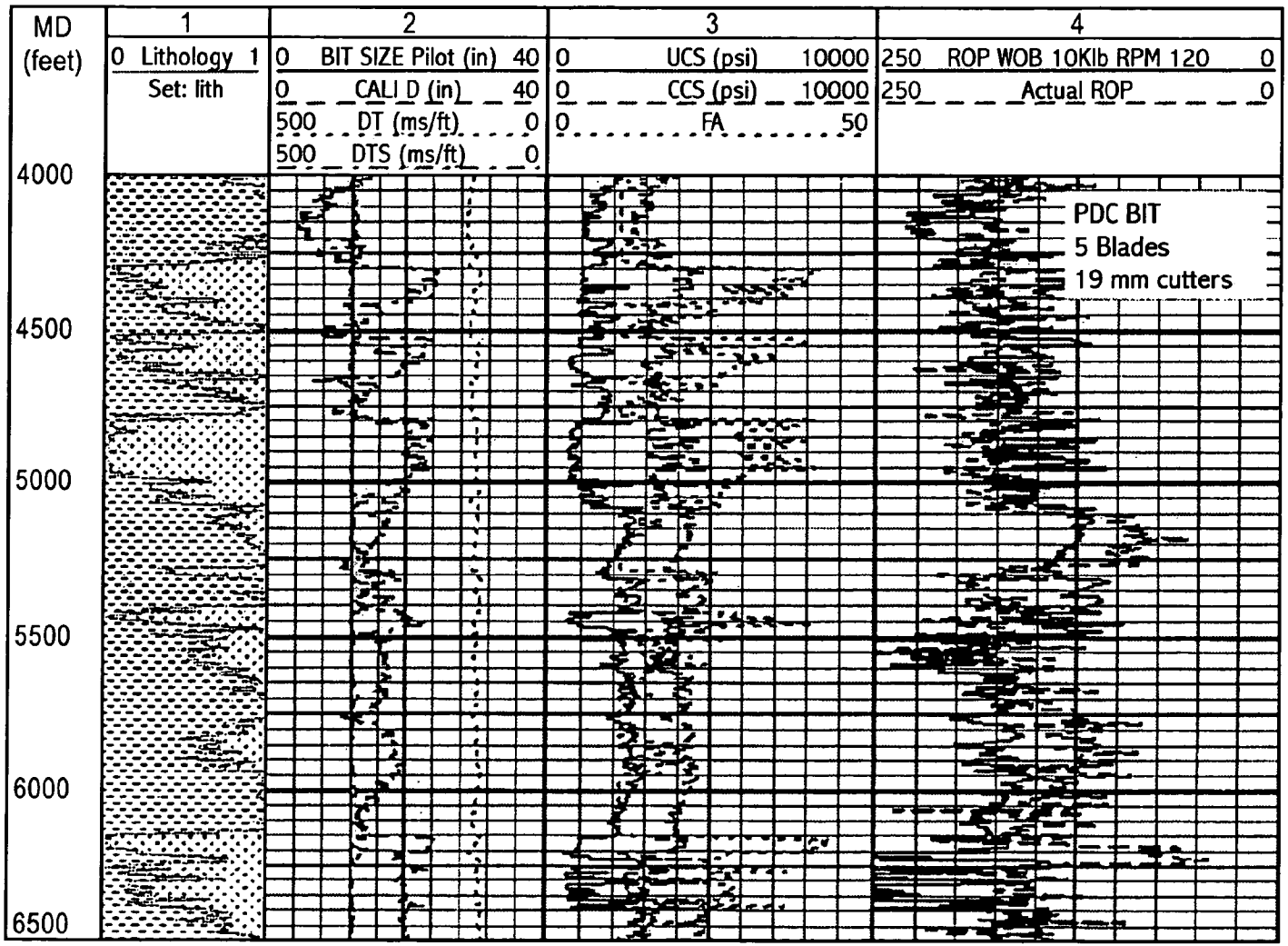
FIG. 14 is chart of a bit optimization and selection for a second well.

FIG. 14 provides another example of the use of the CCS and specific energy ROP model to select the optimum bit for an exploratory well. Log data and drilling data from offset wells are used to create a composite for the proposed well, and then rock mechanics and specific energy ROP analysis are performed.

The evaluation shows that the interval is comprised of low strength rock with CCS ranging between 3,000 psi and 5,000 psi, and that the interval can be drilled with an aggressive PDC bit. The recommended approach is to use a five bladed PDC bit with 19 mm abrasive resistance cutters. The well is drilled at ROP rate of 160 to 180 ft/hr. Although the lithology in the well drilled is not exactly the same as the offset wells, the predicted ROP (solid line, track 4) closely correlates with actual ROP achieved in well drilling.

Well 3

Figure 15:
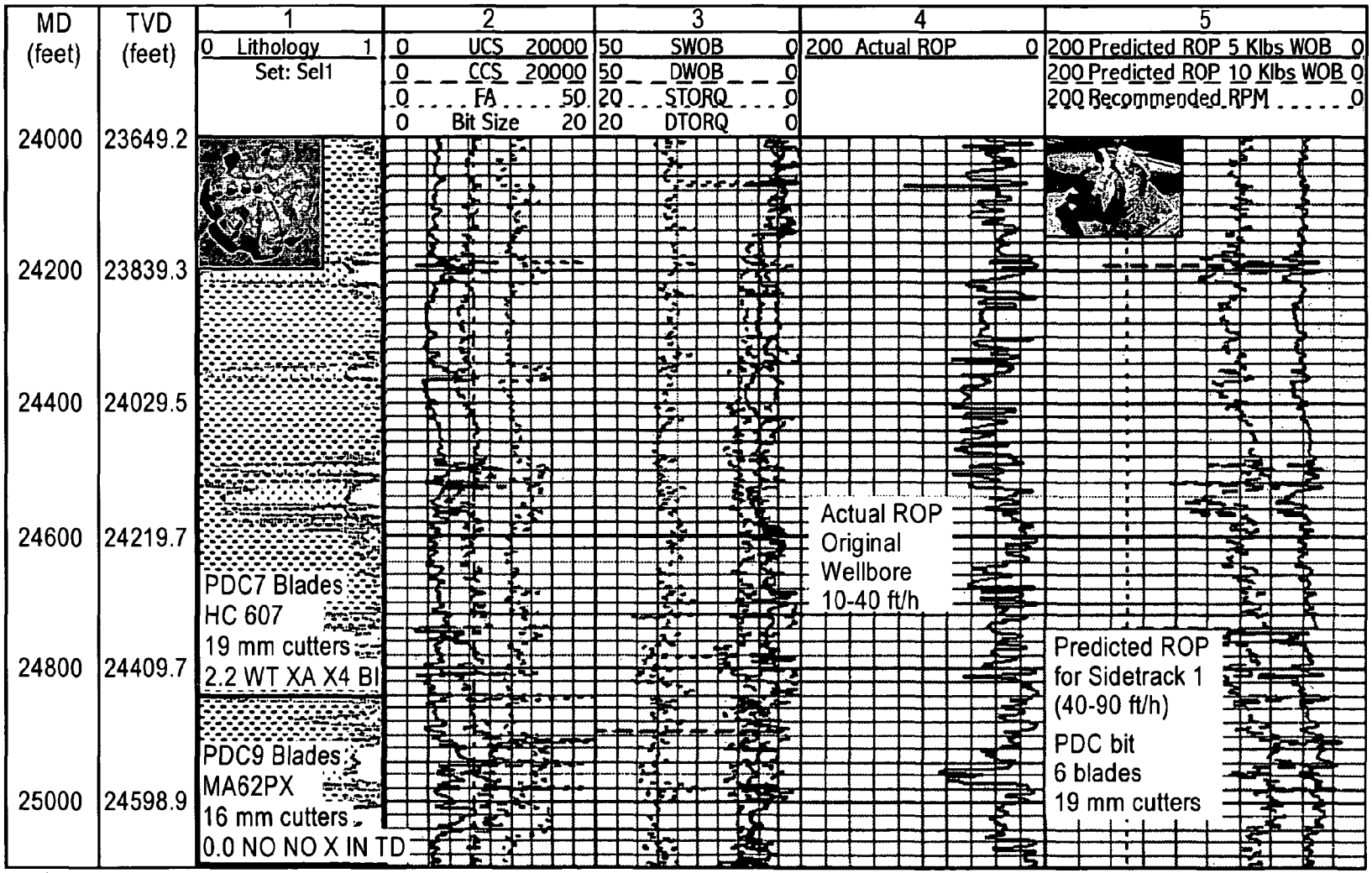
FIG. 15 is chart of a bit optimization and selection for a third well.

FIG. 15 shows the drilling performance for an 8½ in. hole drilled using PDC bits with seven and nine blades. The well was drilled at a ROP of 20 to 40 ft/hr. FIG. 15 also illustrates the bit optimization performed for a sidetrack out of the same well bore. Rock mechanics analysis indicates that the CCS for the interval (CCS, track 2) is between 8,000 psi to 10,000 psi and that the well could be drilled with a more aggressive PDC bits than the bits used to drill the original well bore. The analysis suggested that the sidetrack be drilled with a six bladed PDC bit with 19 mm cutters to achieve better penetration rates. See the actual ROP achieved in original well bore in track 4 and predicted ROPs for the sidetrack in track 5.

The sidetrack was drilled with one PDC bit at ROP of 60 to 80 ft/hr. The sidetrack was drilled in four days rather than eight days required to drill the original wellbore.

Well 4

Figure 16:
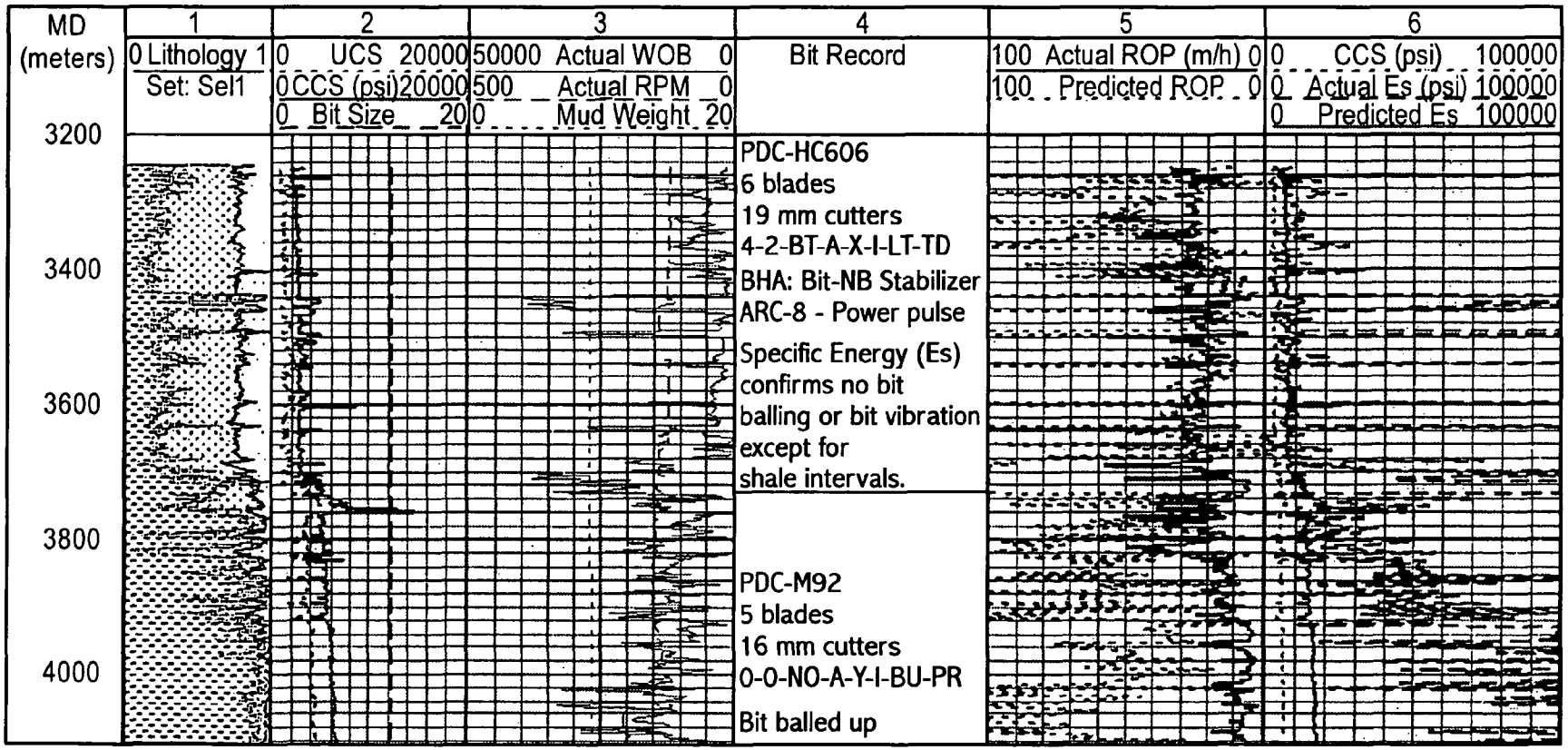
FIG. 16 is chart of a bit optimization and selection for a fourth well.

FIG. 16 shows how the CCS and SEROP models can be used to assess bit performance real-time, and thereby optimize drilling performance. Predicted Es and ROP values can be used to determine whether or not the bit is performing efficiently or whether or not bit efficiency is affected by bit vibration, bit balling, and/or dull bits.

FIG. 16 illustrates that the first bit drilled the top section of interval efficiently as the predicted ROP closely correlates with actual ROP (track 5). In addition, actual Es also correlates with predicted Es except for shale intervals where Es is several times higher than predicted Es (track 6), probably due to bit balling. The second bit drilled the lower part of the section inefficiently. Neither the predicted ROP nor Es matched with the actual ROP and Es. The actual Es was higher than the predicted Es by more than five times, indicating that bit efficiency is extremely low as a result of bit vibration and/or bit balling. The bit record showed that bit was balled up.

While in the foregoing specification this invention has been described in relation to certain preferred embodiments thereof, and many details have been set forth for purposes of illustration, it will be apparent to those skilled in the art that the invention is susceptible to alteration and that certain other details described herein can vary considerably without departing from the basic principles of the invention.

What is claimed is:

1. A method implemented by a processor of a computing device for predicting the rate of drilling of a well bore in a subterranean formation, the method comprising the steps of:

A) determining by the processor the rate of penetration (ROP) of a drill bit drilling a well bore through intervals of rock of a subterranean formation by:

a) determining for at least one type of drill bit a relationship between a bit-specific coefficient of sliding friction μ and confined compressive strength CCS over a range of confined compressive strengths CCS;

b) determining for the at least one type of drill bit a relationship between mechanical efficiency $EFF_M$ and confined compressive strength CCS over a range of confined compressive strengths CCS;

c) determining the confined compressive strength for intervals of rock through which the at least one type of drill bit is to be drilled to form a well bore, the determination of the confined compressive strength based at least in part on an unconfined compressive strength of the intervals; and d) calculating the rate of penetration ROP for the at least one type of drill bit drilling along the intervals of rock to create a well bore, the calculations utilizing the confined compressive strength of the intervals of rock being drilled and the relationships between the bit-specific coefficient of sliding friction μ and the mechanical efficiency $EFF_M$ and the confined compressive strengths CCS; and B) predicting the rate of drilling based on the calculated rate of penetration ROP.

2. The method of claim 1 wherein:

the relationship between the bit-specific coefficient of sliding friction μ and the confined compressive strength CCS over a range of confined compressive strengths CCS for the at least one type of drill bit is dependent upon the weight of the drilling fluid being used to drill an interval of rock.

3. The method of claim 1 wherein:

the relationship between the bit-specific coefficient of sliding friction μ and the confined compressive strength CCS over a range of confined compressive strengths CCS is dependent upon the size of the cutters for polycrystalline diamond compound (PDC) bits.

4. The method of claim 1 wherein:

the relationship between the mechanical efficiency $EFF_M$ and the confined compressive strength CCS over a range of confined compressive strengths CCS for at least one drill bit is dependent upon the weight of the drilling fluid being used to drill the well bore.

5. The method of claim 1 further comprising:

determining a relationship, for the at least one type of drill bit, between the revolutions per minute (N) at which the at least one type of drill bit is to be operated and confined compressive strength CCS over a range of confined compressive strengths CCS; and calculating the rate of penetration ROP for the at least one type of drill bit drilling through the intervals of rock to create a well bore utilizing the confined compressive strength of the intervals of rock being drilled and the relationships between the bit-specific coefficient of sliding friction u, the mechanical efficiency $Eff_M$ and the revolutions per minute (N) at which the drill bit is to be operated and the confined compressive strengths.

6. The method of claim 1 further comprising:

determining a relationship for the at least one drill bit between the weight on bit (WOB) at which the at least one drill bit is to be operated and confined compressive strength CCS over a range of confined compressive strengths CCS; and calculating the rate of penetration for the at least one type of drill bit drilling along the intervals of rock utilizing the confined compressive strength of the intervals of rock being drilled and the relationships between the bit-specific coefficient of sliding friction u, the mechanical efficiency $Eff_M$, and WOB at which the bit should be operated and confined compressive strength.

7. The method of claim 1 wherein:

the rate of penetration is calculated in accordance with the following mathematical expression:

$$ROP = \frac{13.33\ \mu N}{D_B\left(\frac{CCS}{EFF_M \cdot WOB} - \frac{1}{A_B}\right)}$$

where:

ROP=Rate of penetration (ft/hr);

μ=bit-specific coefficient of sliding friction;

N=revolutions per minute of the at least one drill bit;

CCS=Confined compressive strength (psi) of the rock in the interval being drilled;

WOB=weight on bit (lbs);

$EFF_M$=Mechanical efficiency (%);

$D_B$=Bit diameter (in); and $A_B$=Borehole area (sq-in) of the well bore being drilled.

8. The method of claim 1 wherein:

the confined compressive strength (CCS) of an interval of rock is determined at least in part based upon the equivalent circulating density (ECD) of a drilling fluid being used to drill the interval of rock, the overburden stress (OB) removed from the interval of rock being drilled, the in situ pore pressure (PP) of pore fluids proximate the interval of rock being drilled, and the permeability of the interval of rock being drilled.

9. The method of claim 8 wherein:

CCS is calculated in accordance with the following mathematical expression for intervals of rock having low permeability:

$$CCS=UCS+f(DP)$$

where UCS=Unconfined Compressive Strength for the rock; and;

f(DP)=function of the differential pressure DP applied across the rock during drilling.

10. The method of claim 8 wherein:

CCS is calculated in accordance with the following mathematical expression for intervals of rock having low permeability:

$$CCS_{LP}=UCS+DP_{LP}+2DP_{LP}\sin FA/(1-\sin FA);$$

where:

$DP_{LP}$=ECD pressure−(PP−(OB−ECD)/3);

ECD=Equivalent Circulating pressure;

PP=in situ Pore Pressure; and

OB=Overburden pressure.

11. The method of claim 10 wherein:

CCS is calculated in accordance with the following mathematical expression for intervals of rock having high permeability:

$$CCS=UCS+DP+2DP\sin FA/(1-\sin FA)$$

where:

UCS=Unconfined Compressive Strength of the rock;

DP=ECD−PP;

DP=differential pressure between bottom hole pressure exerted by ECD and in-situ pore pressure; and FA=the internal angle of friction of the rock.

12. The method of claim 1 wherein:

the step of determining relationships between the coefficient of sliding friction μ and the mechanical efficiency $Eff_M$ of at least one drill bit as a varying function of a range of confined compressive strengths is bit wear dependent.

13. A method implemented by a processor of a computing device for predicting the rate of drilling of a well bore in a subterranean formation, the method comprising the steps:

A) back calculating by the processor a confined compressive strength CCS of rock in an interval of a subterranean formation in which a well bore has been drilled using a type of drill bit and drilling fluids by:

a) measuring (i) the rate of penetration (ROP); (ii) weight on bit (WOB); (iii) bit torque T; and (iv) the revolutions per minute (N) used during the drilling through an interval of rock in a subterranean formation by the type of drill bit;

b) estimating the coefficient of sliding friction μ during the drilling through the interval of rock; and c) selecting a value of CCS from a predetermined relationship between μ and CCS for the type of drill bit;

d) back calculating an unconfined compressive strength UCS of the rock in the interval; and B) predicting the rate of drilling based on the selected value of CCS.

14. The method of claim 13 wherein:

estimating the coefficient of sliding friction μ is calculated in accordance with the following mathematical expression:

$$\mu = 36\frac{T}{D_B * WOB}$$

where:

T=bit torque (ft-$lb_f$);

$D_B$=bit size (inches);

μ=bit-specific coefficient of sliding friction (dimensionless); and

WOB=weight on bit (lbs).

15. The method of claim 13 further comprising:

determining the mechanical efficiency $EFF_M$ of the drill bit utilizing a predetermined relationship between $EFF_M$ and CCS.

16. The method of claim 13 wherein:

mechanical efficiency $EFF_M$ is calculated in accordance with the mathematical equation:

$$ROP = \frac{13.33\ \mu N}{D_B\left(\frac{CCS}{EFF_M \cdot WOB} - \frac{1}{A_B}\right)}$$

where:

ROP=Rate of penetration (ft/hr);

μ=bit-specific coefficient of sliding friction;

N=revolutions per minute of the at least one drill bit;

CCS=Confined compressive strength (psi) of the rock in the interval being drilled;

WOB=weight on bit (lbs);

$EFF_M$=Mechanical efficiency (%);

$D_B$=Bit diameter (in); and $A_B$=Borehole area (sq-in) of the well bore being drilled.

17. The method of claim 13 wherein:

back calculating the unconfined compressive strength UCS of the rock in the interval is in accordance with the following mathematical expression:

$$CCS=UCS+DP+2DP \sin FA/(1-\sin FA)$$

where:

UCS=rock unconfined compressive strength;

DP=differential pressure (or confining stress) across the rock; and

FA=internal angle of friction of the rock.

* * * * *

UNITED STATES PATENT AND TRADEMARK OFFICE

CERTIFICATE OF CORRECTION

PATENT NO. : 7,991,554 B2
APPLICATION NO. : 12/137752
DATED : August 2, 2011
INVENTOR(S) : Calhoun et al.

It is certified that error appears in the above-identified patent and that said Letters Patent is hereby corrected as shown below:

Column 18, line 67:

"friction u" should read --friction μ--

Column 19, line 13:

"friction u" should read --friction μ--

Signed and Sealed this
Fourth Day of October, 2011

David J. Kappos

David J. Kappos
*Director of the United States Patent and Trademark Office*